US010499180B1

(12) United States Patent
Harper et al.

(10) Patent No.: US 10,499,180 B1
(45) Date of Patent: Dec. 3, 2019

(54) THREE-DIMENSIONAL SOUND FOR PASSENGER NOTIFICATION

(71) Applicant: Zoox, Inc., Foster City, CA (US)

(72) Inventors: Jacob Avi Harper, Alameda, CA (US); Jeremy Yi-Xiong Yang, New York, NY (US); Forrest Leighton Merrill, Walnut Creek, CA (US); Koun Han, Foster City, CA (US); Timothy John Leo Koenig, San Francisco, CA (US); Subasingha Shaminda Subasingha, Weston, FL (US)

(73) Assignee: Zoox, Inc., Foster City, CA (US)

( * ) Notice: Subject to any disclaimer, the term of this patent is extended or adjusted under 35 U.S.C. 154(b) by 0 days.

(21) Appl. No.: 15/983,008

(22) Filed: May 17, 2018

(51) Int. Cl.
*H04S 7/00* (2006.01)
*H04R 5/02* (2006.01)

(52) U.S. Cl.
CPC ..... *H04S 7/303* (2013.01); *H04R 5/02* (2013.01); *H04R 2499/13* (2013.01)

(58) Field of Classification Search
CPC .. H04S 7/303; H04S 2400/11; H04S 2420/11; H04R 5/02; H04R 2499/13
USPC ... 381/1, 2, 5, 302, 124, 310, 56, 58, 86, 91
See application file for complete search history.

(56) References Cited

U.S. PATENT DOCUMENTS

| | | | | |
|---|---|---|---|---|
| 9,612,123 | B1 | 4/2017 | Levinson | |
| 9,878,689 | B1 | 1/2018 | Jimenez | |
| 10,166,999 | B1 * | 1/2019 | Weng | B60W 50/14 |
| 2017/0263120 | A1 * | 9/2017 | Durie, Jr. | G08G 1/205 |
| 2017/0316533 | A1 * | 11/2017 | Goldman-Shenhar | G06Q 50/30 |
| 2018/0132052 | A1 * | 5/2018 | Muench | H04R 1/406 |
| 2018/0190282 | A1 * | 7/2018 | Mohammad | G10K 11/178 |
| 2018/0202822 | A1 * | 7/2018 | DeLizio | G01C 21/3407 |

* cited by examiner

*Primary Examiner* — William A Jerez Lora
(74) *Attorney, Agent, or Firm* — Lee & Hayes, P.C.

(57) ABSTRACT

Techniques for utilizing three-dimensional (3D) sound for passenger notification are described herein. Computing device(s) onboard a vehicle can determine an occurrence of an event associated with a passenger of the vehicle or the vehicle, and can determine a 3D sound associated with the event. Then, the computing device(s) can send a signal associated with the 3D sound to a speaker system inside of the vehicle and, responsive to receiving the signal, one or more speakers of the speaker system can output the 3D sound such that a sound associated with the 3D sound is perceived to be localized relative to the passenger in the vehicle.

20 Claims, 8 Drawing Sheets

THREE-DIMENSIONAL SOUND FOR PASSENGER NOTIFICATION

BACKGROUND

While autonomous vehicles continue to become more prevalent, they have yet to become commonplace. Many people have not experienced travel in autonomous vehicles and do not trust or understand how to interact with autonomous vehicles, especially in the absence of human direction to which people are accustomed. Unlike human drivers, autonomous vehicles may not give many of the visual or auditory cues that passengers are accustomed to being provided with while traveling in vehicles driven by human drivers. For example, a human driver can tell their passengers when their seatbelts are not fastened. Additionally, human drivers can tell their passengers when they have arrived at their destination and the passengers are to exit the vehicle. The lack of trust that many human passengers have for autonomous vehicles results in reluctance by many humans to adopt autonomous vehicle transportation.

Furthermore, to the extent vehicles include speakers for communicating with drivers and/or passengers of a vehicle, such speakers are omnidirectional. That is, existing techniques for communicating with drivers and/or passengers of a vehicle are directed to the omnidirectional projection of notifications out of all speakers in a vehicle and/or a dedicated lo-fi speaker in a dashboard of the vehicle. For some vehicles, especially those having bidirectional carriage seating configurations, omnidirectional notifications are too ambiguous and can lead to confusion for multiple passengers.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
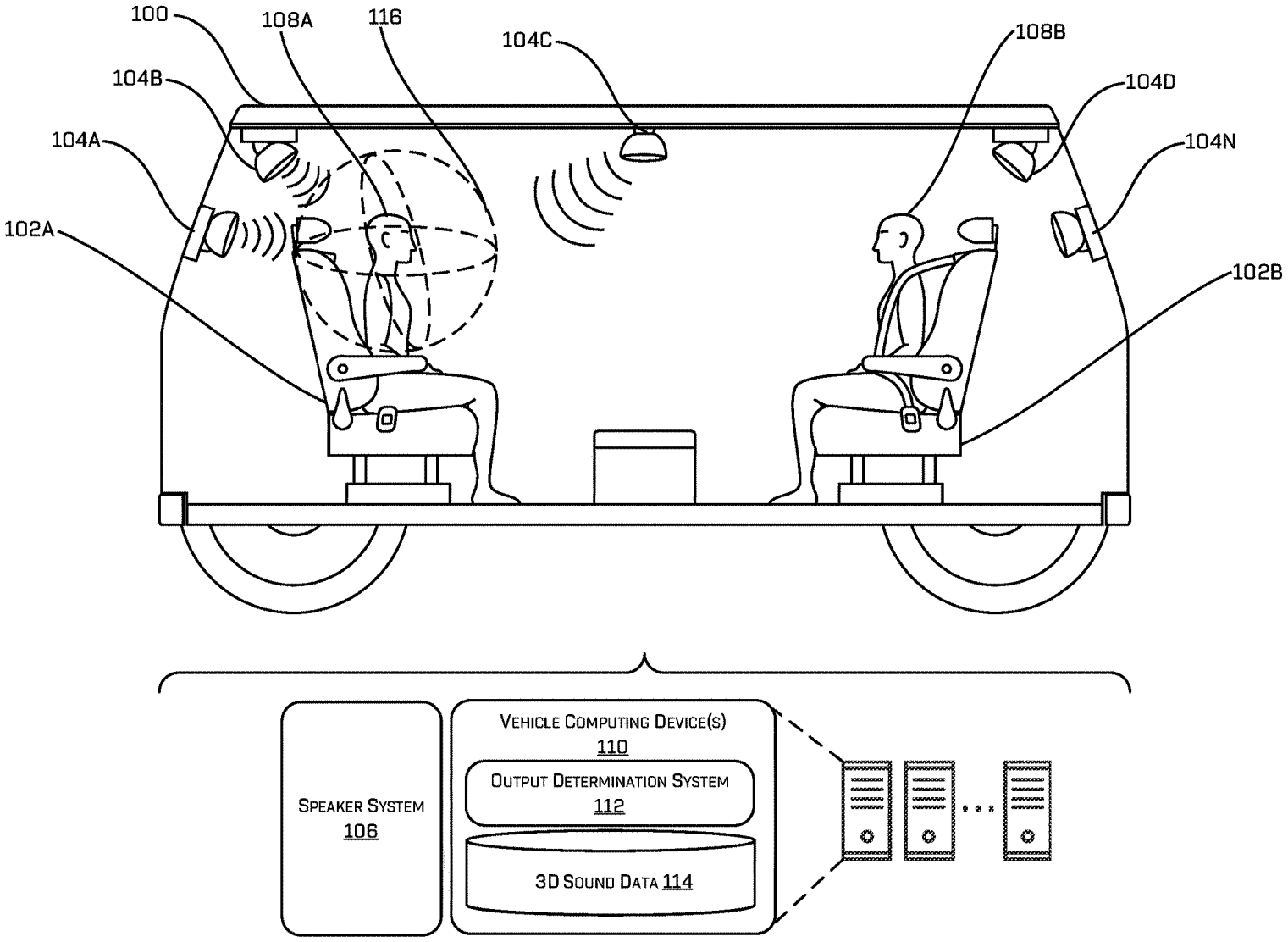
FIG. 1 is a schematic diagram illustrating an example of a vehicle capable of localizing sound via three-dimensional (3D) sound responsive to an event.

Techniques for utilizing three-dimensional (3D) sound for passenger notifications are described herein. For example, 3D sound can be used to mitigate confusion caused by traditionally omnidirectional outputs by providing targeted, localized notifications to specific passengers. In an example, 3D sound techniques can be used to alert a specific passenger (e.g., that his/her seatbelt is not fastened, of an emergency, of an object in a surrounding environment, etc.). Additionally, 3D sound techniques can be used for providing a sustained auditory output to communicate a notification to one or more passengers (e.g., ingress, egress, etc.). Further, 3D sound techniques can be useful for staging how passengers interact with voice agents. Moreover, 3D sound techniques can be used for facilitating audio ducking (e.g., reducing the presence of one audio signal by the presence of another signal) and otherwise enhancing passengers' experiences. Such localized sound outputs can enable passengers to gain trust and increase comfort levels with autonomous vehicles, thereby increasing the likelihood of many humans to adopt autonomous vehicle transportation.

With 3D sound, sound engineers can manipulate sounds so that sounds produced by speakers mimic natural sound waves as if emanating from a point in a 3D space. That is, 3D sound, as used herein, enables the human brain to perceive different sounds in different 3D locations (e.g., using Head Related Transfer Functions (HRTF), spherical harmonic decomposition, sound field synthesis, etc.), even though the sounds can be produced from a small number of speakers (e.g., as opposed to surround sound). In at least one example, techniques described herein are directed to using 3D sound to provide notifications to passengers of a vehicle. For instance, in at least one example, computing device(s) onboard a vehicle can determine an occurrence of an event associated with a passenger of the vehicle or the vehicle itself, and can access, from a data storage storing associations between 3D sounds and events, a 3D sound corresponding to the event. Then, the computing device(s) can send a signal associated with the 3D sound to a speaker system disposed in the interior of the vehicle and, responsive to receiving the signal, one or more speakers of the speaker system can output the 3D sound such that a sound associated with the 3D sound is perceived to be localized relative to the passenger in the vehicle.

As described above, unlike human drivers, autonomous vehicles may not give many of the visual or auditory cues that passengers are accustomed to being provided with while traveling in a vehicle driven by a human driver. Furthermore, to the extent vehicles include speakers for communicating with drivers and/or passengers of a vehicle, such speakers are omnidirectional. That is, existing techniques for communicating with drivers and/or passengers of a vehicle are directed to the omnidirectional projection of notifications out of all speakers in a vehicle and/or a dedicated lo-fi speaker in a dashboard of the vehicle. For some vehicles, especially autonomous vehicles having bidirectional carriage seating configurations, omnidirectional notifications are too ambiguous and can lead to confusion for multiple passengers. Techniques described herein can use 3D sound to facilitate interaction between vehicles and passengers of such vehicles in such a way that passengers can easily determine when they are the intended recipients of a communication. That is, techniques described herein are directed to utilizing 3D sound to mitigate confusion caused by traditionally omnidirectional sounds by providing targeted, localized notifications to specific passengers. Such techniques are particularly helpful in enabling passengers to interact with autonomous vehicles safely and with more confidence than existing technologies provide.

FIGS. 1-8 below provide various examples of the techniques described above.

FIG. 1 is a schematic diagram illustrating a vehicle 100 capable of localizing sound via 3D sound responsive to an event. For the purpose of illustration, the vehicle 100 can be an autonomous vehicle configured to operate according to a Level 5 classification issued by the U.S. National Highway Traffic Safety Administration, which describes a vehicle capable of performing all safety-critical functions for the entire trip, with the driver (or occupant) not being expected to control the vehicle at any time. In such an example, since the vehicle 100 can be configured to control all functions from start to stop, including all parking functions, it can be unoccupied. This is merely an example, and the systems and methods described herein can be incorporated into any ground-borne, airborne, or waterborne vehicle, including those ranging from vehicles that need to be manually controlled by a driver at all times, to those that are partially or fully autonomously controlled. In an alternative example, the vehicle 100 can be a manually driven vehicle (e.g., not autonomously controlled). Additional details associated with the vehicle 100 are described below.

In at least one example, the vehicle 100 can have a bidirectional carriage seating configuration whereby at least a first seat 102A is disposed on a first side of an interior of the vehicle 100 and at least a second seat 102B is disposed on a second side of the interior of the vehicle 100, the second side being opposite the first side. In at least one example, the first seat 102A and the second seat 102B can be facing each other as illustrated in FIG. 1. While two seats are shown, in additional or alternative examples, the vehicle 100 can have any number of seats. Furthermore, in alternative examples, the seats can be configured in a configuration other than bidirectional carriage seating. For instance, in an alternative example, the seats can be configured in a traditional forward-facing, unidirectional seating configuration.

As illustrated in FIG. 1, the vehicle 100 can include one or more speakers (e.g., speakers 104A-N) that comprise a speaker system 106. In at least one example, the speakers 104A-104N can be output devices (e.g., emitters) that are designed to produce audio output that can be heard by one or more listeners, which, in FIG. 1 can be passenger 108A and/or passenger 108B. That is, the speakers 104A-104N can be configured to output sound in an interior of the vehicle 100.

In at least one example, the vehicle 100 can be associated with one or more vehicle computing devices 110. The vehicle computing device(s) 110 can include, among other components and/or systems described below, an output determination system 112 and a 3D sound data storage 114. The output determination system 112 can determine when to output a 3D sound that is to be output via the speaker system 106. In at least one example, the output determination system 112 can determine to output a particular 3D sound based on determining an occurrence of an event. In FIG. 1, the event corresponds to a determination that the passenger 108A has not fastened his/her seatbelt. In at least one example, one or more sensors associated with the interior of the vehicle 100 can determine that the passenger 108A has not fastened his/her seatbelt (see, for example, U.S. patent application Ser. No. 15/638,764 entitled "Seatbelt System Including Occupant Detector," filed on Jun. 30, 2017, now known as U.S. Pat. No. 9,878,689, which is incorporated by reference herein in its entirety), and the output determination system 112 can determine to output a sound to notify the passenger 108A that his/her seatbelt is not fastened. The sound can be output in association with a 3D sound so that the sound is localized relative to the passenger 108A. Other events are described below with reference to FIGS. 2 and 3.

As illustrated, the vehicle computing device(s) 110 can include the 3D sound data storage 114. The 3D sound data storage 114 can store data files of 3D sounds that have been previously generated. As described above, a data file of a 3D sound can comprise instructions for transforming sound waves (e.g., using HRTF, spherical harmonic decomposition, sound field synthesis, etc.) to output a particular sound so that the sound is perceived by the passenger 108A to be coming from a point, or a plurality of points, in a 3D space that is localized to the passenger 108A. In at least some examples, the point, or the plurality of points, may reside inside the head of the passenger 108A (as may be determined by one or more perception systems as described herein), in proximity of the passenger 108A, in the vehicle 100 (e.g., in the interior/cabin of the vehicle 100), or outside of the vehicle 100. In at least one example, a data file of a 3D sound can represent an audio gesture that, when executed, causes a sound to be output in such a way that the listener(s) perceive the sound to move in a geometric shape in a 3D environment associated with a cabin (e.g., interior) of the vehicle 100. In at least one example, a data file of a 3D sound can be mapped, or otherwise associated with, an indication of an event. For instance, a data file of a 3D sound associated with notifying a passenger that his/her seatbelt is not fastened can be mapped, or otherwise associated with, an indication of an event corresponding to a determination that a passenger's seatbelt is not fastened.

In at least some examples, the 3D sound may be generated dynamically (i.e., not stored in the 3D sound data storage 114). As non-limiting examples, such dynamically generated 3D sounds may comprise geometric patterns calculated algorithmically or randomly in real-time, varying intensities determined in real-time, varying sounds (e.g., music as may be unique to differing passengers) determined in real-time, and the like. In some examples, the 3D sound data storage 532 can store algorithms for dynamically generating such 3D sound.

In at least one example, the output determination system 112 can access the 3D sound data storage 114 to retrieve the data file mapped to, or otherwise associated with, the indication of the event corresponding to a determination that a passenger's seatbelt is not fastened. The output determination system 112 can send a signal to the speaker system 106 to cause the speaker system 106 to output a sound 116 corresponding to the 3D sound so that the sound 116 is perceived by the passenger 108A to be localized to the passenger 108A and/or have a unique impression on the passenger (e.g., follow a path around the passenger 108A). As a result, the passenger 108A can be notified, via the sound 116, that his/her seatbelt is not fastened and can fasten his/her seatbelt. Further, in some examples, other passengers (e.g., the passenger 108B) in the vehicle 100 can hear the sound 116 and determine a point, or plurality of points, in the 3D environment associated with the cabin of the vehicle 100 from which the sound is perceived to originate. As a result, another of the passengers (e.g., the passenger 108B) can advise the passenger 108A to fasten his/her seatbelt. That is, in at least one example, the sound can be associated with an auditory notification.

While FIG. 1 illustrates sound being output from speakers 104A, 104B, and 104C, in additional or alternative examples, sound can be output from any of the speakers 104A-104N in the vehicle 100. Further, though described as a single 3D sound to notify a single passenger (passenger 108A), it should be noted that any number of sounds may simultaneously (or substantially simultaneously) be delivered to any number of passengers in the vehicle 100.

Furthermore, while FIG. 1 is directed to providing a notification to the passenger 108A responsive to determining that the passenger's 108A seatbelt is not fastened, in additional or alternative examples, techniques described herein can be useful for providing notifications to other passenger actions, such as a passenger standing in the cabin of the vehicle 100, a passenger misbehavior in the vehicle 100, a passenger not progressing through a respective ride narrative (e.g., doesn't get out of the vehicle 100, falls asleep, etc.), etc.

Figure 2:
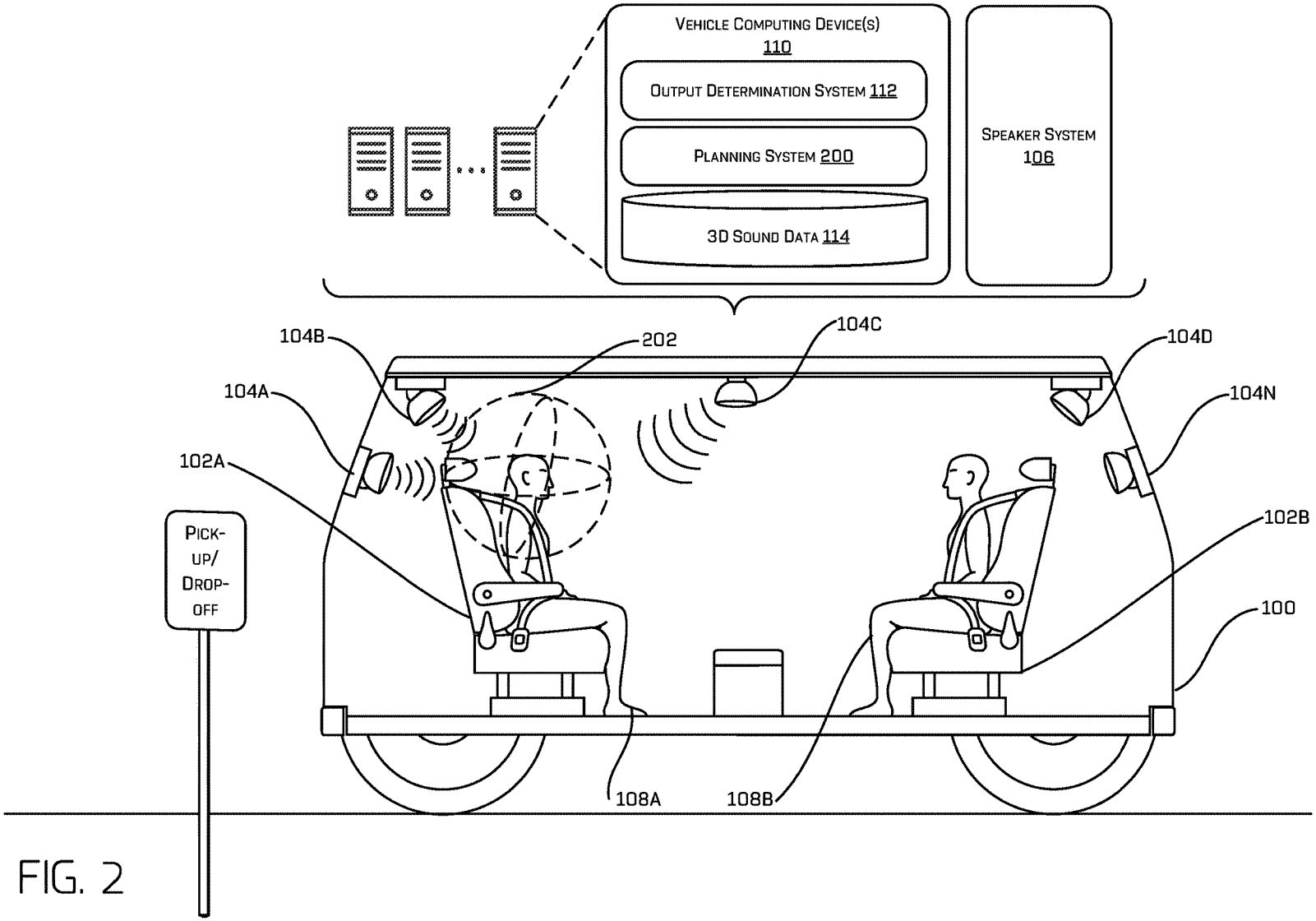
FIG. 2 is a schematic diagram illustrating another example of a vehicle capable of localizing sound via 3D sound responsive to an event.

FIG. 2 is a schematic diagram illustrating the vehicle 100, which as described above with reference to FIG. 1, is capable of localizing sound via 3D sound responsive to an event. In at least one example, the event can correspond to an action of the vehicle 100. For instance, in at least one example, the event can correspond to a passenger pick-up at a location, a passenger drop-off at a location, an emergency stop (or no-go), an acceleration, a deceleration, etc. In such examples, the output determination system 112 can determine an occurrence of the event based at least in part on data received from another system of the vehicle 100, such as a planning system 200.

As illustrated in FIG. 2, the vehicle computing device(s) 110 can include a planning system 200 for generating and executing trajectories to control the vehicle 100. In at least one example, the planning system 200 can be configured to determine a most efficient route to travel from a first location (e.g., a pick-up location) to a second location (e.g., a drop-off location). For the purpose of this discussion, a route can be a sequence of waypoints for travelling between two locations. As non-limiting examples, waypoints include streets, intersections, global positioning system (GPS) coordinates, etc. In at least one example, the planning system 200 can perform a search, such as a graph search, on top of a map to identify a route to guide the vehicle 100 from a first location to a second location. For the purpose of this discussion, a map can be any number of data structures modeled in two-dimensions (2D) or 3D that are capable of providing information about an environment, such as, but not limited to, topologies (such as intersections), streets, mountain ranges, roads, terrain, and the environment in general. In at least one example, the planning system 200 can determine a route (e.g., the sequence of waypoints) and can generate an instruction for guiding the vehicle 100 along at least a portion of the route from the first location to the second location. In some examples, the instruction can be a trajectory, or a portion of a trajectory. In such examples, the planning system 200 can generate a sequence of actions (e.g., drive down the road, accelerate, change lanes, turn left, etc.) to guide the vehicle 100 along the route. In at least one example, the planning system 200 can access, receive, and/or determine real-time processed sensor data and the planning system 200 can process the instruction in view of the real-time processed sensor data. Additional details associated with the planning system are described in U.S. patent application Ser. No. 15/632,208, entitled "Trajectory Generation and Execution Architecture," filed on Jun. 23, 2017, the entire contents of which are incorporated by reference herein.

In at least one example, the output determination system 112 can receive an indication from the planning system 200 that the vehicle 100 has arrived at a pick-up location or a drop-off location, and can determine an occurrence of an event based on such an indication. Responsive to determining the event, the output determination system 112 can access the 3D sound data storage 114 to retrieve a data file corresponding to a 3D sound that is mapped to, or otherwise associated with an indication of a pick-up event or an indication of a drop-off event, respectively. The output determination system 112 can send a signal to the speaker system 106 to cause the speaker system 106 to output the 3D sound so that the sound is perceived by a passenger (or soon to be passenger) to be localized to the passenger (or soon to be passenger). In examples where the passenger is not yet in the vehicle 100, one or more external speakers can be utilized for outputting at least a part of the 3D sound. In some examples, as the passenger enters the vehicle 100, different speakers can be utilized to output the 3D sound (or a different 3D sound) while the passenger navigates to his or her seat.

For instance, in FIG. 2, the output determination system 112 can receive an indication from the planning system 200 that the vehicle 100 has arrived at a drop-off location for dropping off the passenger 108A, and can determine an occurrence of an event based on such an indication. Responsive to determining the event, the output determination system 112 can access the 3D sound data storage 114 to retrieve a data file corresponding to a 3D sound that is mapped to, or otherwise associated with, an indication of a drop-off event. The output determination system 112 can send a signal to the speaker system 106 to cause the speaker system 106 to output the sound 202 corresponding to the 3D sound so that the sound 202 is perceived by the passenger 108A to be localized to the passenger 108A. As a result, the passenger 108A can prepare to exit the vehicle 100 when the vehicle 100 stops at the drop-off location. In at least one example, the sound 202 corresponding to the 3D sound for notifying the passenger 108A can be different than the sound corresponding to the 3D sound for notifying the passenger 108A that his/her seatbelt is not fastened (e.g., sound 116). That is, different notifications can be associated with different sounds so that passengers can distinguish between the notifications, and understand the sentiment associated with individual notifications. In at least one example, the sound 202 associated with the drop-off event can be a sustained auditory output that is output for a particular amount of time. Such a notification can be sustained and spatially immersive, for example, while the passenger 108A exits the vehicle 100 (e.g., during egress). A similar sustained and spatially immersive notification can be output when a passenger enters the vehicle 100 (e.g., during ingress).

While FIG. 2 illustrates sound being output from speakers 104A, 104B, and 104C, in additional or alternative examples, sound can be output from any of the speakers 104A-104N in the vehicle 100.

Furthermore, while FIG. 2 is directed to an example of using 3D sound for notifying a passenger of a drop-off location, other vehicle actions can be associated with other sounds and/or 3D sounds, which can be output via the speaker system 106 to notify the passenger(s) 108A and/or 108B of particular vehicle actions, as described above. For instance, in some examples, techniques described herein can be used for notifying a passenger (e.g., passenger(s) 108A and/or 108B) of an object (e.g., a vehicle, a cyclist, a pedestrian, etc.) in the environment of the vehicle 100. In such examples, the output determination system 112 can use additional or alternative systems of the vehicle 100 to determine an occurrence of an event (e.g., a detection of an object). For instance, the output determination system 112 can utilize a perception system, as described below with reference to FIG. 5, to determine a presence of an object in the environment of the vehicle 100 and can determine an event based on such a determination. As a result, the output determination system 112 can cause a sound to be output utilizing 3D sound to notify the passenger(s) 108A and/or 108B of the presence of such object. Additionally or alternatively, the output determination system 112 can determine an event based on movement of the vehicle (e.g., acceleration, deceleration, stop, etc.), which can be determined utilizing other systems of the vehicle 100 (e.g., a localization system, an IMU, a planning system, the perception system, etc.), and the output determination system 112 can cause a sound to be output utilizing 3D sounds to notify the passenger(s) 108A and/or 108B of such movement. Additional details associated with communicating reasons for vehicle actions are described in U.S. patent application Ser. No. 15/600,258, entitled "Communicating Reasons for Vehicle Actions," and filed on May 19, 2017, the entire contents of which are incorporated herein by reference.

Figure 3A:
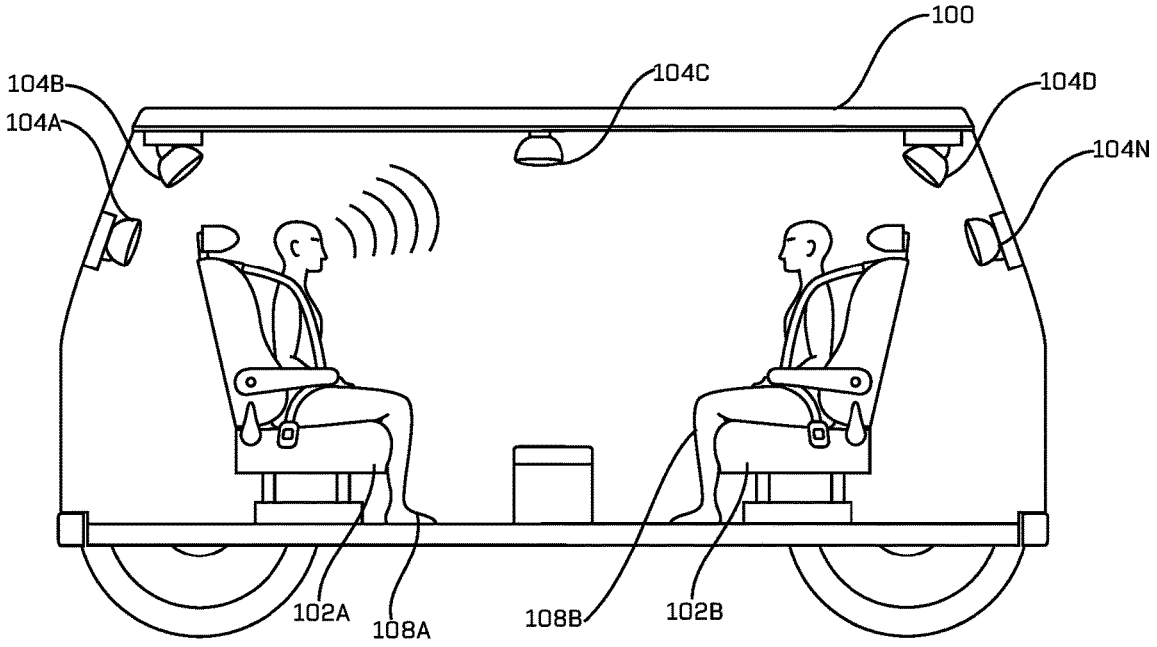
FIGS. 3A and 3B are schematic diagrams illustrating yet another example of a vehicle capable of localizing sound via 3D sound responsive to an event.
Figure 3B:
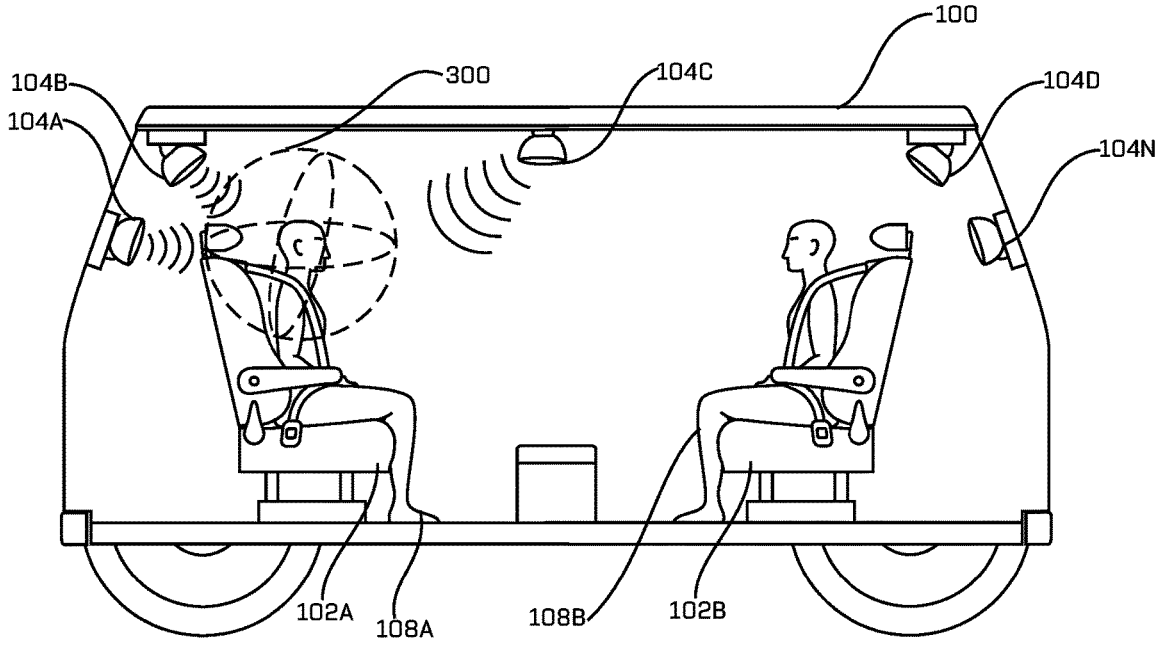

FIGS. 3A and 3B are schematic diagrams illustrating the vehicle 100, which as described above with reference to FIG. 1, is capable of localizing sound via 3D sound responsive to an event. In at least one example, the event can correspond to a voice engagement. Voice engagements can include an interaction with a virtual assistant (e.g., software that incorporates artificial intelligence (AI) with a human-like interface that enables voice response that simulates conversations and integration with different applications and/or platforms that create a virtual identity that passengers can interact with), a phone call (e.g., transmitted by BLUETOOTH® or another network via the speaker system 106), etc. In such examples, the output determination system 112 can determine an occurrence of an event based on receiving an indication of an incoming phone call for a particular passenger (e.g., passenger 108A or passenger 108B) or receiving an indication of an activation word, phrase, etc. (e.g., a hands-free command) that activates the virtual assistant provided by a particular passenger (e.g., passenger 108A or passenger 108B). Responsive to determining the event, the output determination system 112 can access the 3D sound data storage 114 to retrieve a data file corresponding to a 3D sound that is mapped to, or otherwise associated with a voice engagement. The output determination system 112 can send a signal to the speaker system 106 to cause the speaker system 106 to output a sound corresponding to the 3D sound so that the sound is perceived by the relevant passenger (e.g., passenger 108A or passenger 108B) to be localized to the passenger (e.g., passenger 108A or passenger 108B).

As illustrated in FIG. 3A, the passenger 108A is speaking an activation word to activate a virtual assistant. In such an example, the output determination system 112 can determine an occurrence of an event based on receiving an indication of the activation word that activates the virtual assistant provided by the passenger 108A. Responsive to determining the event, the output determination system 112 can access the 3D sound data storage 114 to retrieve a data file corresponding to a 3D sound that is mapped to, or otherwise associated with, an indication of a voice engagement with the virtual assistant. The output determination system 112 can send a signal to the speaker system 106 to cause the speaker system 106 to output a sound 300 corresponding to the 3D sound so that the sound 300 is perceived by the passenger 108A to be localized to the passenger 108A, as illustrated in FIG. 3B. As such, the passenger 108A can receive a confirmation that his/her activation word was received and that the virtual assistant is listening and/or is otherwise ready to interact, and the passenger 108A can interact with the virtual assistant in a manner that is more relatable than when a virtual assistant is emitted from a single, omnidirectional speaker.

While FIG. 3 illustrates sound being output from speakers 104A, 104B, and 104C, in additional or alternative examples, sound can be output from any of the speakers 104A-104N in the vehicle 100.

In some examples, the output determination system 112 can perform one or more ducking techniques, for instance if music is playing when a voice engagement, or other event, is detected. Ducking is a sound effect whereby a first audio signal is reduced, or perceived to be reduced, by the presence of another signal. Traditionally, ducking can be achieved by lowering the volume of a secondary signal when a primary signal starts and lifting the volume again when the primary signal is finished. In at least one example, responsive to determining the event, the output determination system 112 can access the 3D sound data storage 114 to retrieve a data file corresponding to a first 3D sound. Such a 3D sound can cause the music to be perceived by the passenger(s) 108A and/or 108B to be playing at a location away from the vehicle 100. That is, execution of the 3D sound can cause the music to be perceived as originating from a remote location, i.e., a location far outside of the vehicle. The output determination system 112 can send a signal to the speaker system 106 to cause the speaker system 106 to execute the 3D sound so that the music is perceived by the passenger 108A to be localized at a remote location, while maintaining a virtual volume of the 3D sound constant. As such, the passenger 108A can participate in the voice engagement (e.g., call, interaction with the virtual assistant, etc.) while the music is still playing, but at a location remote from the vehicle 100. When the voice engagement concludes (e.g., call is terminated, interaction with the virtual assistant concludes, etc.), the output determination system 112 can access the 3D sound data storage 114 to retrieve a data file corresponding to a lifting 3D sound. Such a 3D sound can cause the music to be perceived by the passenger(s) 108A and/or 108B to return to playing at a location within the vehicle 100. That is, execution of the 3D sound can cause the music to be perceived as originating from a location within the vehicle 100. The output determination system 112 can send a signal to the speaker system 106 to cause the speaker system 106 to execute the 3D sound so that the music is perceived by the passenger(s) 108A and/or 108B to be localized within the vehicle 100. Performing acoustic ducking in such a manner (i.e., moving a virtual 3D point of emanation associated with the sound as opposed to simply lowering a volume) reduces an amount of jarring experienced by the passengers when switching between audio sources.

Figure 4:
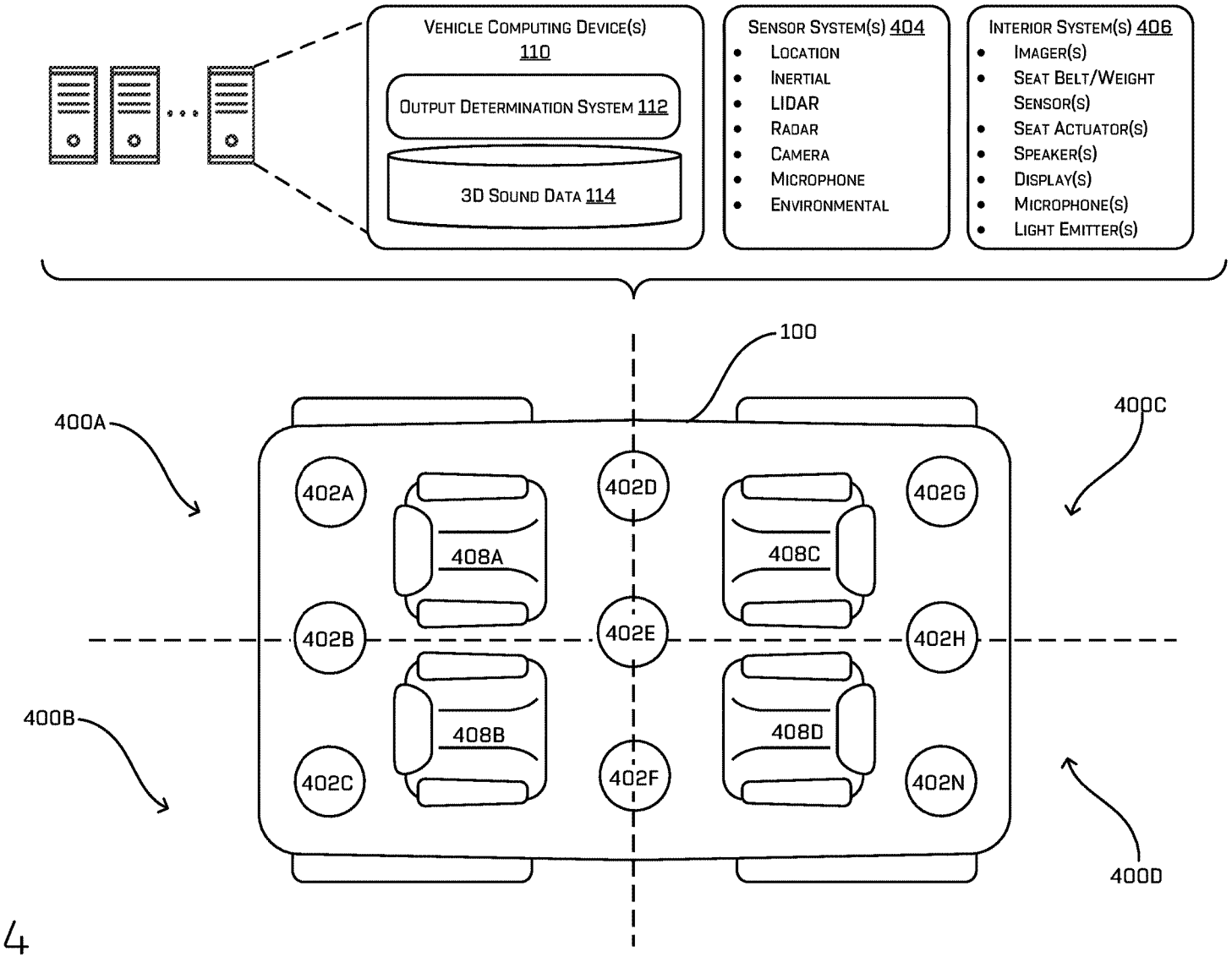
FIG. 4 is a schematic diagram illustrating an example of a vehicle, wherein sound can be localized in a region of the autonomous vehicle.

FIG. 4 is a schematic diagram illustrating an example of a vehicle, such as vehicle 100, wherein sound can be localized in a region of the vehicle responsive to an event. In at least one example, the interior of the vehicle 100 can be partitioned into regions. In FIG. 4, four regions 400A-400D (e.g., quadrants) are illustrated. However, in additional or alternative examples, the interior of the vehicle 100 can be partitioned into more or fewer regions. In at least one example, each region 400A-400D can be associated with one or more speakers 402A-402N.

In at least one example, the output determination system 112 can determine a region associated with an event and can determine which region to direct a sound using 3D sound described above based on such a determination. In at least one example, the output determination system 112 can utilize data received from sensor system(s) 404 and/or interior system(s) 406 associated with the vehicle 100 to determine where passenger(s) are located within the vehicle 100 and can determine how to localize 3D sound notifications based on such data. Based at least in part on identifying the region(s) 400A-400D where a sound is to be directed, the output determination system 112 can send signal(s) to one or more speakers 402A-402N to output a 3D sound notification in the identified region(s) 400A-400D.

As described above, in at least one example, the output determination system 112 can utilize data received from sensor system(s) 404 and/or interior system(s) 406 associated with the vehicle 100 to determine where passenger(s) are located within the vehicle 100. In at least one example, the sensor system(s) 404 can include light detection and ranging (LIDAR) sensors, radio detection and ranging (RADAR) sensors, ultrasonic transducers, sound navigation and ranging (SONAR) sensors, location sensors (e.g., global positioning system (GPS), compass, etc.), inertial sensors (e.g., inertial measurement units, accelerometers, magnetometers, gyroscopes, etc.), cameras (e.g., RGB, IR, intensity, depth, etc.), wheel encoders, microphones, environment sensors (e.g., temperature sensors, humidity sensors, light sensors, pressure sensors, etc.), etc. The sensor system(s) 404 can include multiple instances of each of these or other types of sensors. For instance, the LIDAR sensors can include individual LIDAR sensors located at the corners, front, back, sides, and/or top of the vehicle 100. As another example, the camera sensors can include multiple cameras disposed at various locations about the exterior and/or interior of the vehicle 100. The sensor system(s) 404 can provide input to the vehicle computing device(s) 110.

Additionally, the vehicle 100 can include interior system(s) 406. In at least one example, the interior system(s) 406 can include, but are not limited to, imager(s), seat belt sensor(s), seat weight sensor(s), seat actuator(s), speaker(s), light emitter(s), display(s), microphone(s), etc.

The imagers can be any known types of digital image sensors, digital or analog cameras, and/or digital or analog video cameras. The imager(s) can be high dynamic range (HDR) cameras, for example, to provide improved accuracy of images. In some examples, the imager(s) can include one or more of RGB cameras, intensity cameras, infrared cameras, depth cameras, stereo cameras, or the like. Other suitable types of imager(s) are contemplated. The imager(s) can be selected to provide 2D image data, 3D image data, image sequences, gray image data, and/or color image data. In some examples, the imager(s) can be selected to provide depth data, absorption data, and/or reflectance data. In at least one example, the imager(s) can be aimed at the interior space of the vehicle 100, for example, to provide the vehicle computing device(s) 110 with passenger data.

The seat belt sensor(s) can be simple switches or sensors to detect when a seat belt has been fastened around a passenger and/or cargo. As the name implies, the seat weight sensor(s) can detect the weight of an object in a seat. In some examples, the seat weight sensor(s) can be simple weight sensitive switch(es) with a threshold weight. In this configuration, the seat weight sensor(s) can supply a signal indicating whether or not a weight above a threshold weight (e.g., 60 lbs.) is in the seat. In other examples, the seat weight sensor(s) can comprise strain gauge(s), or other weight sensor(s), capable of determining the actual weight of an object or a passenger in a seat.

In some examples, the seat actuator(s) can be mounted at one or more locations associated with the interior space of the vehicle 100, and can be coupled to, for example, a seat, the floor, a support rail, a support bracket, a support pillar, or other structures. In some examples, the seat actuator(s) can be configured to move a seat from a first position to a second position using energy from, for example, the impact force of a collision, and can apply a counteracting force to the seat to control the acceleration of the seat. In some examples, the counteracting force can be provided by a spring and/or damper of the seat actuator(s).

The speaker(s) can receive data (e.g., signals) to output audio feedback to passenger(s). The speaker(s) can correspond to the speaker system(s) 106 described above with reference to FIGS. 1-3. The display(s) can present text to passenger(s). Additionally, or alternatively, the display(s) can present picture(s), video(s), or graphical representation(s) to passenger(s). In some instances, the display(s) can be part of the vehicle 100, while in other examples, the display(s) can be a device associated with a passenger. For example, an application on the device associated with the passenger can present text or images. The light emitter(s) can be configured to change the ambient light of the interior space of the vehicle 100. For instance, the light emitter(s) can turn on and off the lights, or change the color of the lights, to indicate events and/or actions performed by the vehicle 100. In at least some examples, 3D sound may be localized to a passenger in order to direct the passenger to look at the display(s).

The microphone(s) can capture sounds or words that come from passenger(s) of the vehicle 100. In some examples, the microphone(s) can send audio signals representing the sound captured to vehicle computing device(s) 110. In such examples, the vehicle computing device(s) 110 can perform natural language processing to determine what, if anything, the passenger(s) said, or can analyze the audio signals to determine an ambient noise level.

In at least one example, the output determination system 112 can receive data from the sensor system(s) 404 and/or the interior system(s) 406 and can determine that a passenger's seatbelt is not fastened. For instance, if the seat belt sensor(s) indicate a seat belt associated with a particular seat (e.g., seat 408A) is not fastened and that the seat weight sensor(s) associated with the particular seat (e.g., seat 408A) indicate 135 lbs., it is likely that a passenger is in the vehicle 100 and that the passenger's seatbelt is not fastened. This can be further confirmed using image data from the imager(s) and image recognition software capable of identifying a human being. As above, additional information about such a process is described in reference to U.S. patent application Ser. No. 15/638,764. As a result, the output determination system 112 can leverage such inputs to determine an event (e.g., passenger's seat belt is not fastened). In at least one example, the output determination system 112 can determine which region 400A-400D corresponds to the passenger whose seatbelt is not fastened (e.g., which seat the passenger is occupying and which region the seat is located), and can output the sound via one or more speakers that are associated with the identified region and/or can otherwise cause a relevant 3D sound to be output in the identified region. For instance, if a passenger seated in seat 408A is the intended recipient of a notification (e.g., the passenger has not fastened his/her seatbelt), the output determination system 112 can send a signal to the one or more speakers associated with region 400A. That is, speakers 402A, 402B, 402D, and/or 402E can output at least a portion of the signal to cause the 3D sound, to alert the passenger that his/her seatbelt is not fastened. Additionally or alternatively, any of the speakers 402A-402N can output at least a portion of the signal to cause the 3D sound to be directed to the identified region 400A. That is, in at least some examples, one or more of the speakers 402A-402N can output at least a portion of the signal to cause the 3D sound to be output such that a sound is perceived to be originating from a point in the space corresponding to the identified region 400A.

In another example, the output determination system 112 can determine a voice activation by a particular passenger seated in seat 408D. For instance, if the seat belt sensor(s) indicate the seat belt associated with a particular seat (e.g., seat 408D) is fastened and that the seat weight sensor(s) associated with the particular seat (e.g., seat 408D) indicate 180 lbs., it is likely that a passenger is in the particular seat (e.g., seat 408D). This can be further confirmed using image data from the imager(s) and image recognition software capable of identifying a human being. Then, the microphone(s) can capture sounds or words that come from the particular passenger. In such an example, the vehicle computing device(s) 110 can perform natural language processing to determine that the passenger spoke the activation word for activating a virtual assistant. Based on such a determination, the output determination system 112 can determine which region 400A-400D corresponds to the passenger that spoke the activation word and can output the sound via one or more speakers that are associated with the identified region. For instance, if a passenger seated in seat 408D is the intended recipient of a notification, the output determination system 112 can send a signal to the one or more speakers associated with region 400D. That is, speakers 402E, 402F, 402H, and 402N can output at least a portion of the signal to cause the 3D sound. Additionally or alternatively, any of the speakers 402A-402N can output at least a portion of the signal to cause the 3D sound to be directed to the identified region 400D. That is, in at least some examples, one or more of the speakers 402A-402N can output at least a portion of the signal to cause the 3D sound to be output such that a sound is perceived to be originating from a point in the space corresponding to the identified region 400A.

In some examples, a notification can be an all-passenger notification (e.g., identification of an object in an environment of the vehicle 100), in which case, the output determination system 112 can output the sound corresponding to the notification via one or more speakers in more than one region. In at least one example, the output determination system 112 can leverage data from the sensor system(s) 404 and/or the interior system(s) 406 to determine where passenger(s) are seated in the vehicle 100 and can determine which region(s) 400A-400N correspond to such passenger(s). In an example where the output determination system 112 causes an all-passenger notification to be output, the output determination system 112 can localize the all-passenger notification to the passenger(s) in the vehicle 100 by sending a signal to the one or more speakers associated with region(s) corresponding to passenger(s) that are seated in the vehicle 100. Additionally or alternatively, any of the speakers 402A-402N can output at least a portion of the signal to cause the 3D sound to be directed to the identified region(s). Non-limiting examples of such an all-passenger notification includes, but is not limited to, emergency stops, ingress and egress notifications, route changes, communicating vehicle states, and the like.

Figure 5:
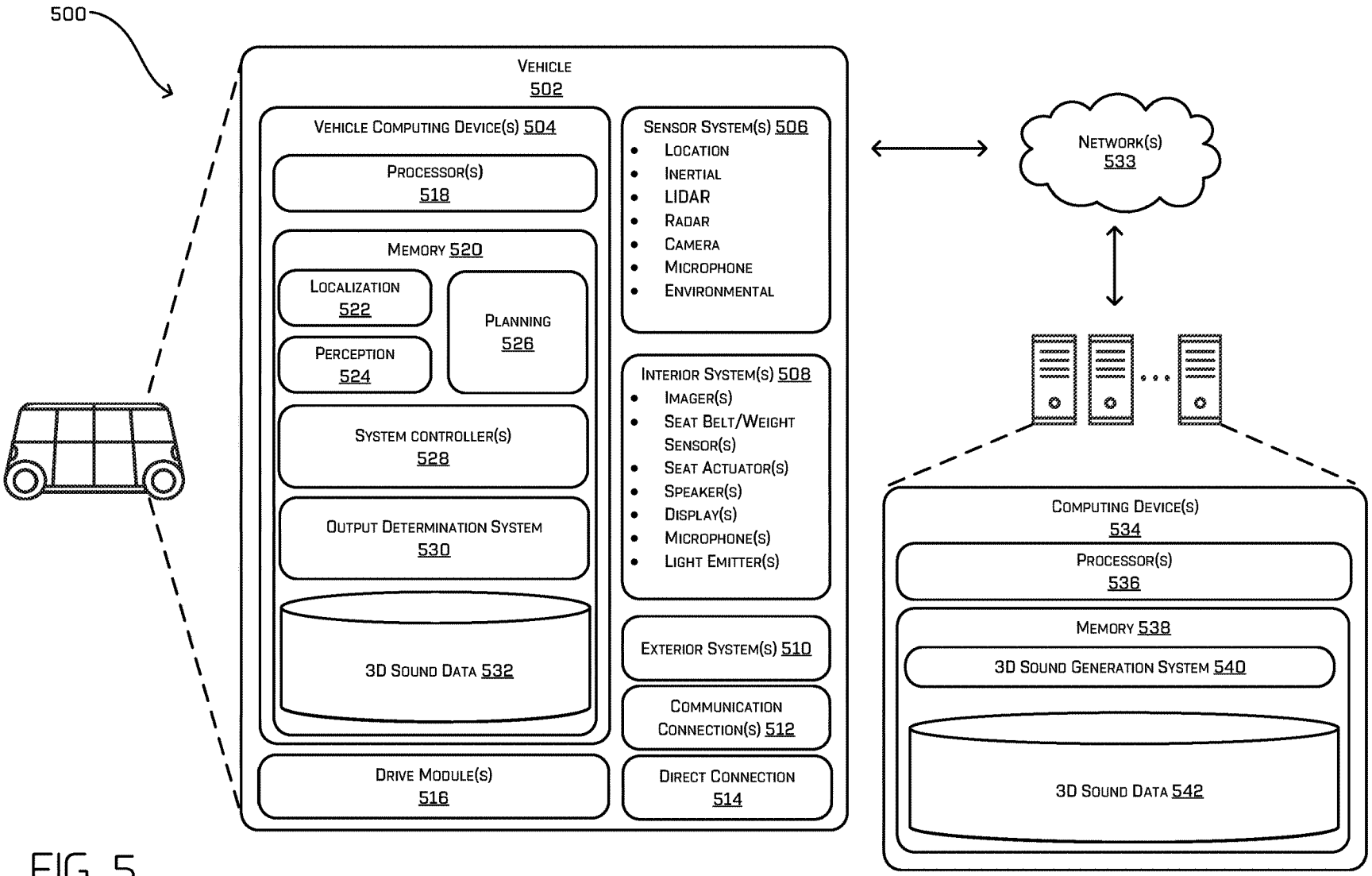
FIG. 5 is a block diagram illustrating an example system for generating and/or utilizing 3D sound for passenger notifications.

FIG. 5 is a block diagram illustrating an example system 500 for generating and/or utilizing 3D sound for passenger notifications. In at least one example, the system 500 can include a vehicle 502, which can be the same vehicle as the vehicle 100 described above with reference to FIGS. 1-4.

The vehicle 502 can include one or more vehicle computing devices 504, one or more sensor systems 506, one or more interior systems 508, one or more exterior systems 510, one or more communication connections 512, at least one direct connection 514, and one or more drive modules 516.

In at least one example, the vehicle computing device(s) 110 described above with reference to FIGS. 1-4 can correspond to the vehicle computing device(s) 504. The vehicle computing device(s) 504 can include one or more processors 518 and memory 520 communicatively coupled with the one or more processors 518. In the illustrated example, the vehicle 502 is an autonomous vehicle; however, the vehicle 502 could be any other type of vehicle. In the illustrated example, the memory 520 of the vehicle computing device(s) 504 stores a localization system 522, a perception system 524, a planning system 526, one or more system controllers 528, an output determination system 530, and a 3D sound data storage 532.

In at least one example, the localization system 522 can determine where the vehicle 502 is in relation to a local and/or global map based at least in part on sensor data received from the sensor system(s) 506 and/or map data associated with a map, as described above. In at least one example, the perception system 524 can perform object detection, segmentation, and/or classification based at least in part on sensor data received from the sensor system(s) 506. For instance, in at least one example, the perception system 524 can identify other objects, such as another vehicle, a cyclist, a pedestrian, etc., in the environment within which the vehicle 502 is positioned. Furthermore, the perception system 524 can track one or more of a position, an orientation, or a velocity of other objects in the environment. In at least one example, the planning system 526, which can correspond to the planning system 200 described above with reference to FIG. 2, can determine routes and/or trajectories to use to control the vehicle 502 based at least in part on sensor data received from the sensor system(s) 506. Such routes may comprise, for examples, pickup locations, drop-off locations, points of interest, in addition to any other points which may be communicated to the one or more passengers in accordance with the techniques and systems presented herein. Additional details of localization systems, perception systems, and/or planning systems that are usable can be found in U.S. patent application Ser. No. 14/932,963, entitled "Adaptive Mapping to Navigate Autonomous Vehicle Responsive to Physical Environment Changes," and filed Nov. 4, 2015, now known as U.S. Pat. No. 9,612,123, and Ser. No. 15/632,208, entitled "Trajectory Generation and Execution Architecture," and filed Jun. 23, 2017, the entire contents of which are incorporated herein by reference. In an example where the vehicle 502 is not an autonomous vehicle, one or more of the aforementioned systems components can be omitted from the vehicle 502.

In at least one example, the vehicle computing device(s) 504 can include one or more system controllers 528, which can be configured to control steering, propulsion, braking, safety, emitters, communication, and other systems of the vehicle 502. These system controller(s) 528 can communicate with and/or control corresponding systems of the drive module(s) 516 and/or other components of the vehicle 502.

As described above, the memory 520 can include an output determination system 530. In at least one example, the output determination system 530 can correspond to the output determination system 112 described above. Furthermore, the memory 520 is illustrated as including a 3D sound data storage 532, which can correspond to the 3D sound data storage 114 described above. The 3D sound data storage 532 can include data files associated with 3D sounds that correspond to events, as described above. In some examples, the 3D sound data storage 532 can store algorithms for dynamically generating such 3D sounds. While the 3D sound data storage 532 is illustrated as being stored in the memory 520, in additional or alternative examples, at least a portion of the 3D sound data storage 532 can be stored external to the memory 520 and/or stored remotely, and can be accessible to the output determination system 530.

In at least one example, as described above, the output determination system 530 can determine an occurrence of an event and, responsive to determining the occurrence of the event, can access the 3D sound data storage 532 to retrieve the data file mapped to, or otherwise associated with, an indication of the event. The output determination system 530 can send a signal to a speaker system, as described herein, to cause the speaker system to output a sound associated with the 3D sound so that the sound is perceived by a particular passenger to be localized to the passenger. Additional details are described above with respect to FIGS. 1-4 and below with respect to FIGS. 6-8.

In at least some examples, the output determination system 530 can generate the 3D sound dynamically (i.e., the 3D sound may not stored in the 3D sound data storage 114). As non-limiting examples, such dynamically generated 3D sounds may comprise geometric patterns calculated algorithmically or randomly in real-time, varying intensities determined in real-time, varying sounds (e.g., music as may be unique to differing passengers) determined in real-time, and the like.

The sensor system(s) 506 can correspond to the sensor system(s) 404 described above. The sensor system(s) 506 can provide input to the vehicle computing device(s) 504.

The vehicle 502 can include interior system(s) 508 and exterior system(s) 510. In at least one example, the interior system(s) 508 can correspond to the interior system(s) 406 described above. The exterior system(s) 510 can include, among other components, one or more emitters for emitting light and/or sound. By way of example and not limitation, the exterior emitters in this example include light emitters (e.g., indicator lights, signs, light arrays, projectors, etc.) to visually communicate with pedestrians, other drivers, other nearby vehicles, etc., one or more audio emitters (e.g., speakers, speaker arrays, horns, etc.) to audibly communicate with pedestrians, other drivers, other nearby vehicles, etc., etc. In at least one example, the emitters can be disposed at various locations about the exterior of the vehicle 502.

The vehicle 502 can also include one or more communication connection(s) 512 that enable communication between the vehicle 502 and one or more other local or remote computing device(s). For instance, the communication connection(s) 512 can facilitate communication with other local computing device(s) on the vehicle 502 and/or the drive module(s) 516. Also, the communication connection(s) 512 can allow the vehicle to communicate with other nearby computing device(s) (e.g., other nearby vehicles, traffic signals, etc.). The communications connection(s) 512 also enable the vehicle 502 to communicate with a remote teleoperations computing device or other remote services.

The communications connection(s) 512 can include physical and/or logical interfaces for connecting the vehicle computing device(s) 504 to another computing device or a network, such as network(s) 533. For example, the communications connection(s) 512 can enable Wi-Fi-based communication such as via frequencies defined by the IEEE 802.11 standards, short range wireless frequencies such as BLUETOOTH®, or any suitable wired or wireless communications protocol that enables the respective computing device to interface with the other computing device(s).

In at least one example, the direct connection 514 can provide a physical interface to couple the one or more drive module(s) 516 with the body of the vehicle 502. For example, the direct connection 514 can allow the transfer of energy, fluids, air, data, etc. between the drive module(s) 516 and the vehicle 502. In some instances, the direct connection 514 can further releasably secure the drive module(s) 516 to the body of the vehicle 502.

In at least one example, the vehicle 502 can include one or more drive modules 516. In some examples, the vehicle 502 can have a single drive module 516. In at least one example, if the vehicle 502 has multiple drive modules 516, individual drive modules 516 can be positioned on opposite ends of the vehicle 502 (e.g., the front and the rear, etc.). In at least one example, the drive module(s) 516 can include one or more sensor systems to detect conditions of the drive module(s) 516 and/or the surroundings of the vehicle 502. By way of example and not limitation, the sensor system(s) can include one or more wheel encoders (e.g., rotary encoders) to sense rotation of the wheels of the drive module, inertial sensors (e.g., inertial measurement units, accelerometers, gyroscopes, magnetometers, etc.) to measure orientation and acceleration of the drive module, cameras or other image sensors, ultrasonic sensors to acoustically detect objects in the surroundings of the drive module, LIDAR sensors, RADAR sensors, etc. Some sensors, such as the wheel encoders can be unique to the drive module(s) 516. In some cases, the sensor system(s) on the drive module(s) 516 can overlap or supplement corresponding systems of the vehicle 502 (e.g., sensor system(s) 506).

The drive module(s) 516 can include many of the vehicle systems, including a high voltage battery, a motor to propel the vehicle 502, an inverter to convert direct current from the battery into alternating current for use by other vehicle systems, a steering system including a steering motor and steering rack (which can be electric), a braking system including hydraulic or electric actuators, a suspension system including hydraulic and/or pneumatic components, a stability control system for distributing brake forces to mitigate loss of traction and maintain control, an HVAC system, lighting (e.g., lighting such as head/tail lights to illuminate an exterior surrounding of the vehicle), and one or more other systems (e.g., cooling system, safety systems, onboard charging system, other electrical components such as a DC/DC converter, a high voltage junction, a high voltage cable, charging system, charge port, etc.). Additionally, the drive module(s) 516 can include a drive module controller which can receive and preprocess data from the sensor system(s) and to control operation of the various vehicle systems. In some examples, the drive module controller can include one or more processors and memory communicatively coupled with the one or more processors. The memory can store one or more modules to perform various functionalities of the drive module(s) 516. Furthermore, the drive module(s) 516 also include one or more communication connection(s) that enable communication by the respective drive module with one or more other local or remote computing device(s).

As described above, the vehicle 502 can communicate with one or more computing devices 534 via the network(s) 533. The computing device(s) 534 can include one or more processors 536 and memory 538 communicatively coupled with the one or more processors 536. In at least one example, a 3D sound generation system 540 and a 3D sound data storage 542 can be stored in the memory 538. In at least one example, the 3D sound generation system 540 can be used to generate 3D sounds. That is, the 3D sound generation system 540 can be used to generate one or more sound effects that, when executed, cause a particular 3D sound. For instance, in at least one example the 3D sound generation system 540 can enable sound engineers to generate a data file that can be used to control the position of audio sources in a 3D environment (such as the interior of the vehicle 502). In at least one example, the 3D sound generation system 540 can enable sound engineers to program spatialization parameters without regard to output formats. Further, the 3D sound generation system 540 can enable sound engineers to generate 3D sounds that can be integrated into various workflows using hardware and/or software interfaces for outputting audible sounds (e.g., speaker system(s) 106, as described above). In at least one example, sound engineers can generate data files representative of 3D sounds for outputting a sound responsive to a particular event. In at least one example, the 3D sound generation system 540 can map, or otherwise associate, 3D sounds with indications of events and such mappings and/or associations can be stored in the 3D sound data storage 542. In some examples, the 3D sound data storage 542 can store algorithms for dynamically generating such 3D sounds. In at least one example, at least a portion of the 3D sound data storage 542 can be provided to the vehicle 502. While the 3D sound data storage 542 is illustrated as being stored locally in the memory 538, in an alternative example, the 3D sound data storage 542 can be stored external to the memory 538 and/or stored remotely, and can be accessible to the computing device(s) 534. As above, in addition to any stored 3D sound data, such 3D sound data may additionally, or alternatively, be generated dynamically (e.g., according to one or more algorithms) such that passenger notifications are unique to various events and/or passengers. In at least some examples, prerecorded 3D sound data may be preferred so as to reduce computational resources required.

The processor(s) 518 of the vehicle computing device(s) 504 and the processor(s) 536 of the computing device(s) 534 can be any suitable processor capable of executing instructions to process data and perform operations as described herein. By way of example and not limitation, the processor(s) 518 and 536 can comprise one or more Central Processing Units (CPUs), Graphics Processing Units (GPUs), or any other device or portion of a device that processes electronic data to transform that electronic data into other electronic data that can be stored in registers and/or memory. In some examples, integrated circuits (e.g., ASICs, etc.), gate arrays (e.g., FPGAs, etc.), and other hardware devices can also be considered processors in so far as they are configured to implement encoded instructions.

Memory 520 of the vehicle computing device(s) 504 and memory 538 of the computing device(s) 534 are examples of non-transitory computer-readable media. Memory 520 and 538 can store an operating system and one or more software applications, instructions, programs, and/or data to implement the methods described herein and the functions attributed to the various systems. In various implementations, the memory can be implemented using any suitable memory technology, such as static random access memory (SRAM), synchronous dynamic RAM (SDRAM), nonvolatile/Flash-type memory, or any other type of memory capable of storing information. The architectures, systems, and individual elements described herein can include many other logical, programmatic, and physical components, of which those shown in the accompanying figures are merely examples that are related to the discussion herein.

It should be noted that while FIG. 5 is illustrated as a distributed system, in alternative examples, components of the vehicle 502 can be associated with the computing device(s) 534 and/or components of the computing device(s) 534 can be associated with the vehicle 502. That is, the vehicle 502 can perform one or more of the functions associated with the computing device(s) 534, and vice versa. Furthermore, while the sensor system(s) 506, the interior system(s) 508, exterior system(s) 510, etc. are shown as being external to the vehicle computing device(s) 504, in additional or alternative examples, at least some of the sensor system(s) 506, the interior system(s) 508, exterior system(s) 510, etc. can be integrated into the vehicle computing device(s) 504.

Figure 6:
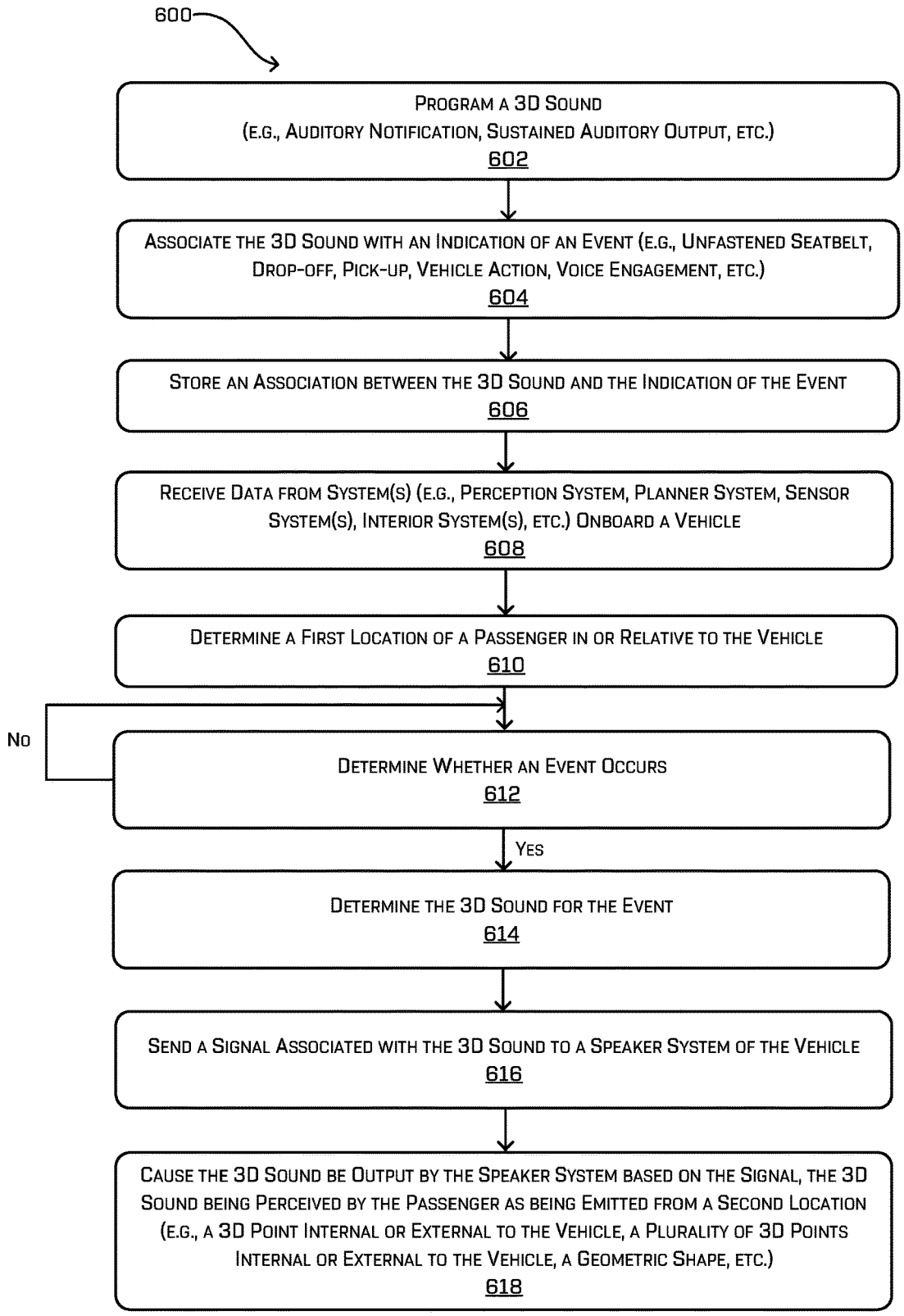
FIG. 6 is a flow diagram illustrating an example process for generating and/or utilizing 3D sound for passenger notifications.
Figure 7:
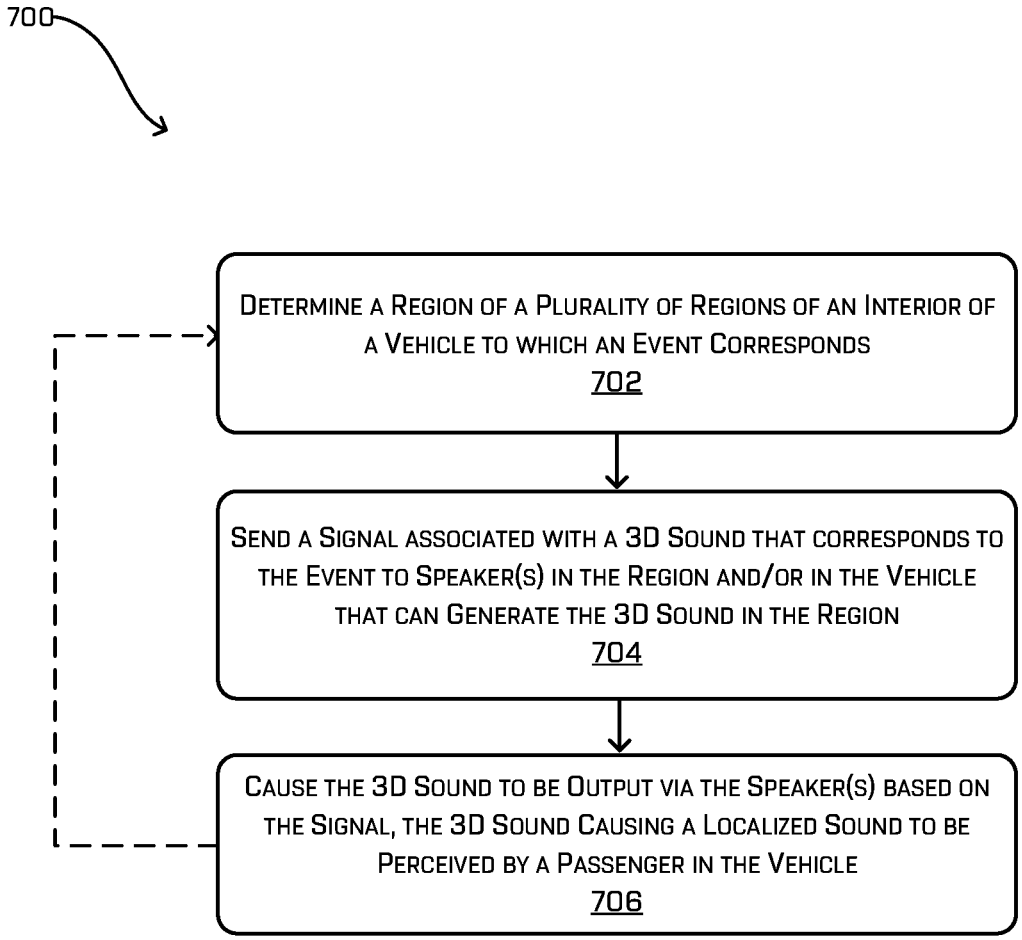
FIG. 7 is a flow diagram illustrating an example process for determining a region for outputting a 3D sound for passenger notification.
Figure 8:
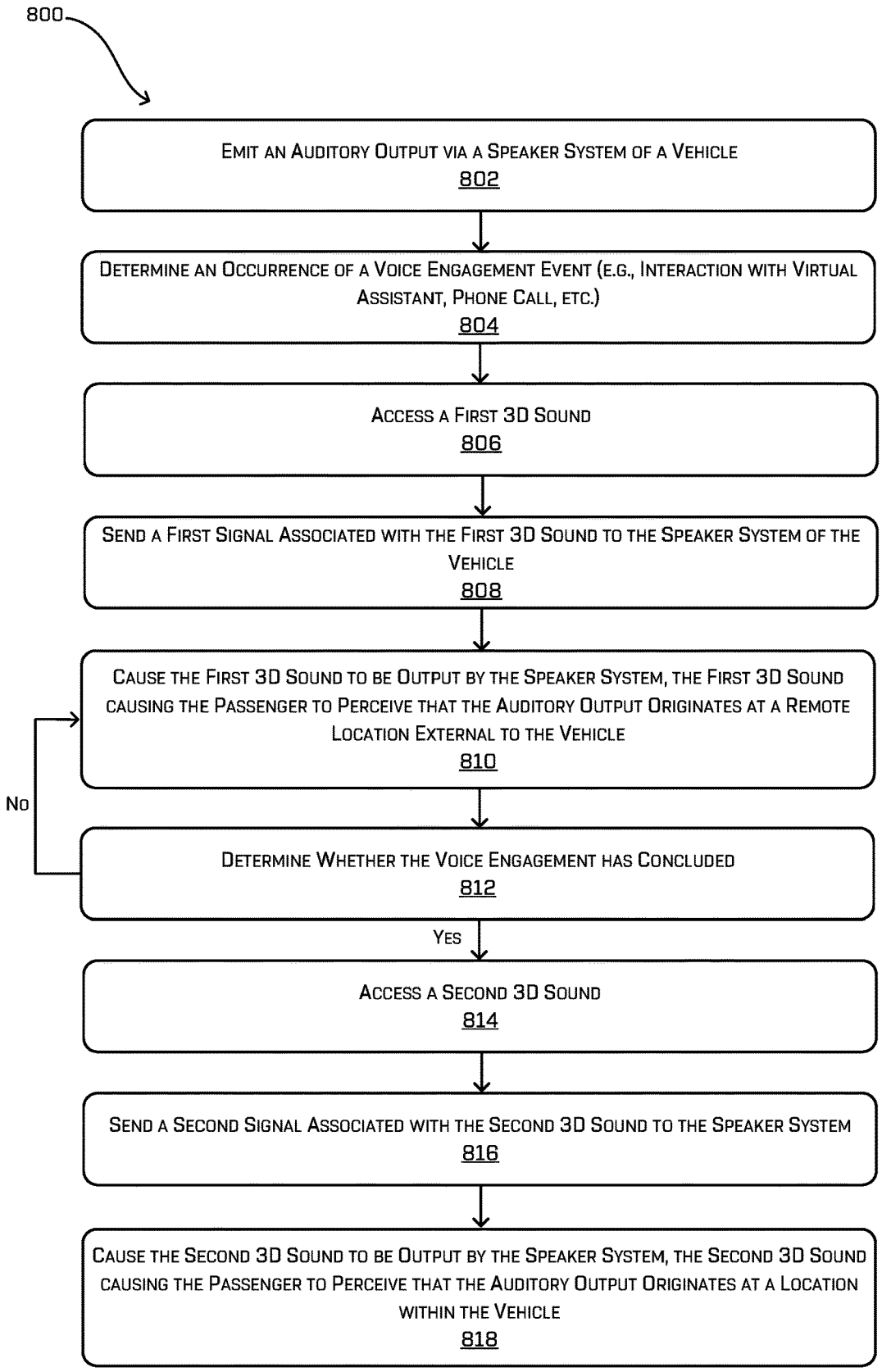
FIG. 8 is a flow diagram illustrating an example process for utilizing 3D sound for creating a ducking effect (e.g., reducing the presence of one audio signal by the presence of another signal).

FIGS. 6-8 are flowcharts showing example methods involving the use of 3D sound for providing notifications to passengers as described herein. The methods illustrated in FIGS. 6-8 are described with reference to the vehicle 502 shown in FIG. 5 for convenience and ease of understanding. However, the methods illustrated in FIGS. 6-8 are not limited to being performed using vehicle 502 shown in FIG. 5, and can be implemented using any of the other vehicles described in this application, as well as vehicles other than those described herein. Moreover, the vehicle 502 described herein is not limited to performing the methods illustrated in FIGS. 6-8.

The methods 600-800 are illustrated as collections of blocks in logical flow graphs, which represent sequences of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the processes. In some embodiments, one or more blocks of the process can be omitted entirely. Moreover, the methods 600-800 can be combined in whole or in part with each other or with other methods.

The various techniques described herein can be implemented in the context of computer-executable instructions or software, such as program modules, that are stored in computer-readable storage and executed by the processor(s) of one or more computers or other devices such as those illustrated in the figures. Generally, program modules include routines, programs, objects, components, data structures, etc., and define operating logic for performing particular tasks or implement particular abstract data types.

FIG. 6 is a flow diagram illustrating an example process 600 for generating and/or utilizing 3D sound for passenger notifications.

Block 602 illustrates programming a 3D sound (e.g., auditory notification, sustained auditory output, etc.). As described above, one or more computing devices 534 can include a 3D sound generation system 540, which can be used to generate one or more sound effects that, when executed, cause a particular 3D sound. For instance, in at least one example the 3D sound generation system 540 can enable sound engineers to generate data files that can be used to control the position of audio sources in a 3D environment (such as the interior of the vehicle 502). In at least one example, the 3D sound generation system 540 can enable sound engineers to program spatialization parameters without regard to output formats. Further, the 3D sound generation system 540 can enable sound engineers to generate 3D sounds that can be integrated into various workflows using hardware and/or software interfaces for outputting audible sounds (e.g., speaker system(s) 106, as described above). In at least one example, sound engineers can generate data files representative of 3D sounds for outputting a sound responsive to a particular event.

Block 604 illustrates associating the 3D sound with an indication of an event (e.g., unfastened seatbelt, drop-off, pick-up, vehicle action, voice engagement, etc.). In at least one example, the 3D sound generation system 540 can map, or otherwise associate, 3D sounds with indications of events, and such mappings and/or associations can be stored in a 3D sound data storage 542. In at least one example, the 3D sound data storage 542 can store data files of 3D sounds that have been previously generated. As described above, a data file of a 3D sound can comprise instructions for transforming sound waves (e.g., using HRTF, spherical harmonic decomposition, sound field synthesis, etc.) to output a particular sound so that the sound is perceived by the passenger 108A to be coming from a point in a 3D space (e.g., the interior of the vehicle 100) that is localized to the passenger 108A, creates a geometric shape about the passenger, is common to all passengers as if it was unique to each passenger, and the like. In at least one example, mappings and/or associations between data files of 3D sounds and indications of corresponding events can be stored in the 3D sound data storage 542, as illustrated in block 606. In at least one example, at least a portion of the 3D sound data storage 542 can be provided to the vehicle 502.

Block 608 illustrates receiving data from system(s) (e.g., perception system, planning system, sensor system(s), interior system(s), etc.) onboard a vehicle. As described above, a vehicle 502 can include an output determination system 530. In at least one example, the output determination system 530 can receive data output from one or more systems of the vehicle 502. For instance, the output determination system 530 can receive data from the perception system 524, the planning system 526, the sensor system(s) 506, the interior system(s) 508, the exterior system(s) 510, etc.

In at least one example, the output determination system 530 can utilize the data received from the perception system 524, the planning system 526, the sensor system(s) 506, the interior system(s) 508, the exterior system(s) 510, etc. to determine a first location of a passenger in or relative to the vehicle 100, as illustrated in block 610. Furthermore, in at least one example, the output determination system 530 can utilize the data received from the perception system 524, the planning system 526, the sensor system(s) 506, the interior system(s) 508, the exterior system(s) 510, etc. to determine whether an event occurs, as illustrated in block 612. That is, the output determination system 530 can utilize data from the perception system 524, the planning system 526, the sensor system(s) 506, the interior system(s) 508, the exterior system(s) 510, etc. to determine an occurrence of an event. Non-limiting examples of events include a passenger action (e.g., seatbelt unfastened, standing, misbehaving, not progressing through the ride narrative, etc.), a vehicle action (e.g., passenger pick-up at a location, a passenger drop-off at a location, an emergency stop (or no-go), an acceleration, a deceleration, etc.), a voice engagement, etc.

Based at least in part on determining that an event occurs, the 3D sound data storage 532 can determine a 3D sound associated with the event, as illustrated in block 614. As described above, the 3D sound data storage 532 can store data files of 3D sounds that have been previously generated. As described above, a data file of a 3D sound can comprise instructions for transforming sound waves (e.g., using HRTF, spherical harmonic decomposition, sound field synthesis, etc.) to output a particular sound so that the sound is perceived by the passenger 108A to be coming from a point and/or a plurality of points in a 3D space (e.g., the interior of the vehicle 100, external to the vehicle 100) that is localized to the passenger 108A (including inside the head of passenger 108A as may be determined from various perception systems as described in detail herein). In at least one example, a data file of a 3D sound can represent an audio gesture that, when executed, causes a sound to be output in such a way that the listener(s) perceive the sound to move in a geometric shape in a 3D environment associated with a cabin (e.g., interior) of the vehicle 100. In at least one example, a data file of a 3D sound can be mapped, or otherwise associated with, an indication of an event. In at least one example, as described above, the output determination system 530 can determine an occurrence of an event and, responsive to determining the occurrence of the event, can access the 3D sound data storage 532 to retrieve the data file mapped to, or otherwise associated with, an indication of the event. Additionally or alternatively, in addition to any stored 3D sound data, such 3D sound data may additionally, or alternatively, be generated dynamically (e.g., according to one or more algorithms) such that passenger notifications are unique to various events and/or passengers. In some examples, the 3D sound data storage 532 can store algorithms for dynamically generating such 3D sounds. In at least some examples, prerecorded 3D sound data may be preferred so as to reduce computational resources required.

If the output determination system 530 does not determine that an event occurs, in block 612, the output determination system 530 can continue to analyze data received from the perception system 524, the planning system 526, the sensor system(s) 506, the interior system(s) 508, the exterior system(s) 510, etc. to determine whether an event occurs.

Block 616 illustrates sending a signal associated with the 3D sound to a speaker system of the vehicle. In at least one example, the output determination system 530 can send a signal to a speaker system associated with the vehicle 502 to cause the speaker system to output a sound corresponding to the 3D sound so that the sound is perceived by a passenger to be localized to the passenger. In at least one example, the output determination system 530 can utilize data from microphone(s) associated with the vehicle 502 to assess the ambient noise level of the interior or exterior of the vehicle 502. In such an example, the output determination system 530 can determine a volume associated with the 3D sound based at least in part on the ambient noise level and include an indication of the volume with the signal that is sent to the speaker system. Furthermore, as described below with reference to FIG. 7, in some examples, the output determination system 530 can determine a region of the vehicle 502 to which a 3D sound is to be output (e.g., a region of the vehicle 502 where the passenger is located and/or an event corresponds). In such examples, the output determination system 530 can send a signal to indicate how the speaker system is to output the 3D sound to ensure the 3D sound is output in the identified region of the vehicle 502.

Block 618 illustrates causing the 3D sound to be output by the speaker system based on the signal, the 3D sound being perceived by a passenger of the vehicle to be emitted from a second location. As described above, the vehicle 502 can include one or more interior systems 508, which can include a speaker system. As described above, the speaker system can include one or more speakers, which can be output devices (e.g., emitters) that are designed to produce audio output that can be heard by one or more listeners. That is, the speaker(s) can receive data (e.g., signals) to output audio feedback to passenger(s). In at least one example, the output determination system 530 can send one or more signals to the speaker system which can output the 3D sound so that the sound emitted is perceived by the passenger of the vehicle to be emitted from a second location. In at least one example, the second location can correspond to a 3D point in the vehicle 100 (e.g., the interior/cabin), a 3D point external to the vehicle 100, a plurality of 3D points in the vehicle 100, a plurality of 3D points external to the vehicle 100, a geometric shape, etc.

FIG. 7 is a flow diagram illustrating an example process 700 for determining a region for outputting a 3D sound for passenger notification.

Block 702 illustrates determining a region of a plurality of regions of an interior of a vehicle to which an event corresponds. As described above, in at least one example, the output determination system 530 can determine a region associated with an event and can determine which region to direct a sound using 3D sounds described above based on such a determination. In at least one example, the output determination system 530 can utilize data received from sensor system(s) 506 and/or interior system(s) 508 associated with the vehicle 502 to determine where passenger(s) are located within the vehicle 502 and can determine how to localize 3D sound notifications based on such data.

Block 704 illustrates sending a signal associated with a 3D sound that corresponds to the event to speaker(s) associated with the region and/or any number of speakers associated with the vehicle which can be utilized to generate the 3D sound in the region. Based at least in part on identifying the region(s) where a sound is to be directed, the output determination system 530 can send signal(s) to one or more speakers to output a 3D sound notification. In at least one example, the signal(s) can instruct individual speakers of the one or more speakers to produce audio output consistent with the 3D sound, localized based on the identified region.

Block 706 illustrates causing the 3D sound to be output via the speaker(s) based on the signal, the 3D sound causing a localized sound to be perceived by a passenger in the vehicle. As described above, based at least in part on receiving the signal, the speaker system can output sound associated with the 3D sound via one or more speakers associated with the region corresponding to the event. In some examples, the speaker system can output the sound via one or more speakers that are associated with the identified region (or which can be utilized to generate the desired 3D sound) to produce audio output consistent with the 3D sound, localized to the identified region. As described above, in some examples, speakers that are not associated with the identified region can additionally or alternatively produce audio output to cause a relevant 3D sound to be output in the identified region.

In at least one example, process 700 can repeat, as shown by the dashed arrow returning to block 702, to update which speaker(s) are utilized to produce the audio output for effectuating the 3D sound in particular region(s) of the interior of the vehicle 502.

FIG. 8 is a flow diagram illustrating an example process 800 for utilizing 3D sound for creating a ducking effect. In some examples, the output determination system 530 can perform one or more ducking techniques, for instance if music is playing when a voice engagement is detected. Ducking techniques described with respect to FIG. 8 may reduce an amount of jarring experienced by the one or more passengers when switching between multiple audio sources in response to an event (e.g., switching from music to an incoming voice call or interacting with an artificially intelligent agent and back). FIG. 8 is but one example of a ducking technique that can be implemented utilizing 3D sound. Additional or alternative ducking techniques are considered to be within the scope of this disclosure.

Block 802 illustrates emitting an auditory output via a speaker system of a vehicle. In at least one example, a vehicle 502 can output an auditory output (e.g., music, a call, an audio track of a video, etc. via one or more speakers of the vehicle 502.

Block 804 illustrates determining an occurrence of a voice engagement event. As described above, in at least one example, the output determination system 530 can determine an occurrence of a voice engagement event based on receiving an indication of an incoming phone call for a particular passenger or receiving an indication of an activation word, phrase, etc. (e.g., a hands-free command) that activates the virtual assistant (e.g., an artificially intelligent agent) provided by a particular passenger.

Block 806 illustrates accessing a first 3D sound. In at least one example, responsive to determining the voice engagement event, the output determination system 530 can access the 3D sound data storage 532 to retrieve a data file corresponding to a 3D sound that can cause the auditory output to be perceived by passenger(s) in the vehicle 502 to be playing at a location away from the vehicle 502, while maintaining a constant virtual volume (i.e., a constant volume with respect to the location). That is, execution of the 3D sound can cause the auditory output to be perceived as originating from a remote location.

Block 808 illustrates sending a first signal associated with the first 3D sound to the speaker system of the vehicle. The output determination system 530 can send a signal to the speaker system to cause the speaker system to execute the 3D sound so that the auditory output is perceived by the passenger to be localized at a remote location, as illustrated in block 810. In at least some examples, a secondary audio signal (e.g., a call, voice assistant, etc.), may begin substantially contemporaneously with the ducking effect and/or brought in by a lifting effect. As such, the passenger can participate in the voice engagement (e.g., call, interaction with the virtual assistant, etc.) while the auditory output (e.g., the primary audio signal) is being emitted, but at a location perceived by the passenger(s) to be remote from the vehicle 502.

Block 812 illustrates determining whether the voice engagement has concluded. Based at least in part on determining that the voice engagement has concluded (e.g., call is terminated, interaction with the virtual assistant concludes, etc.), the output determination system 530 can access the 3D sound data storage 532 to retrieve a data file corresponding to a second 3D sound, as illustrated in block 814. Such a 3D sound can cause the auditory output to be perceived by the passenger(s) 108A and/or 108B to return to being emitted at a location within the vehicle 502. That is, execution of the 3D sound can cause the auditory output to be perceived as originating from a location within the vehicle 502.

Block 816 illustrates sending a second signal associated with the second 3D sound to the speaker system. The output determination system 530 can send a signal to the speaker system to cause the speaker system to execute the 3D sound so that the auditory output is perceived by the passenger(s) 108A and/or 108B to be localized within the vehicle 502, as illustrated in block 818.

In examples where the voice engagement has not concluded, the output determination system 530 can continue to output a signal to cause the second 3D sound to be output by the speaker system as illustrated in block 810. As a result of process 800, 3D sound techniques can be used for facilitating audio ducking, reducing jarring effects otherwise caused by abruptly switching audio signals, and otherwise enhancing passengers' music experiences.

EXAMPLE CLAUSES

A. A system comprising: one or more processors; and one or more computer-readable instructions that, when executed by the one or more processors, cause the system to: receive sensor data from a sensor in an interior of an autonomous vehicle; determine, based at least in part on the sensor data, a first location of a passenger in the autonomous vehicle; determine, based on a vehicle system onboard the autonomous vehicle, an occurrence of the event associated with the autonomous vehicle or the passenger in the autonomous vehicle; send a signal associated with a three-dimensional (3D) sound to a speaker system configured to direct sound to an interior of the autonomous vehicle, the 3D sound corresponding to the event; and cause the 3D sound to be output by the speaker system based at least in part on the signal, wherein the 3D sound, when output by the speaker system, is configured to cause the passenger to perceive the 3D sound as being emitted from a second location.

B. The system as paragraph A recites, wherein the interior of the autonomous vehicle is associated with a plurality of regions and the one or more computer-readable instructions further cause the system to: identify a region of the plurality of regions associated with the event, the region proximate the second location; and cause the 3D sound to be output via two or more speakers of the speaker system that correspond to the region.

C. The system as any of paragraphs A-B recite, wherein the event corresponds to an unfastened seatbelt, a passenger pick-up, a passenger drop-off, or a voice engagement.

D. A method comprising: receiving sensor data from a sensor of a vehicle; determining, based at least in part on the sensor data, a first location of a passenger; determining, by a computing device onboard a vehicle, an occurrence of an event; determining a first three-dimensional (3D) sound corresponding to the event; sending a signal associated with the first 3D sound to a speaker system configured to direct sound to an interior of the vehicle; and responsive to receiving the signal, outputting the first 3D sound via a plurality of speakers of the speaker system such that a sound associated with the first 3D sound is to be perceived by the passenger as emanating from a second location.

E. The method as paragraph D recites, further comprising: determining, based at least in part on the sensor data, an indication that a seatbelt of the passenger is not fastened; and determining the occurrence of the event responsive to receiving the indication, wherein the second location is at or near the first location.

F. The method as any of paragraphs D-E recite, further comprising: receiving, from a planning system associated with the vehicle, an indication of an action of the vehicle; and determining the occurrence of the event responsive to receiving the indication.

G. The method as paragraph F recites, wherein the action is associated with a passenger pick-up or a passenger drop-off.

H. The method as any of paragraphs D-G recite, further comprising: determining, based at least in part on input via a microphone associated with the interior of the vehicle or a cellular receiver associated with the vehicle, a voice engagement; and determining the occurrence of the event responsive to determining the voice engagement.

I. The method as paragraph H recites, further comprising: prior to determining the voice engagement and determining the occurrence of the event, outputting an auditory output via the speaker system such that the passenger perceives the auditory output as emanating from a third location internal to the vehicle; responsive to determining the voice engagement, outputting the auditory output via the speaker system such that the passenger perceives the auditory output as emanating from a fourth location external to the vehicle; outputting a voice output associated with the event via the speaker system such that the passenger perceives the voice output as emanating from the second location; determining a conclusion of the voice engagement; and responsive to determining the conclusion of the voice engagement, outputting auditory output via the speaker system such that the passenger perceives the auditory output as emanating from the third location.

J. The method as paragraph H recites, wherein the voice engagement is a phone call or an interaction with a virtual assistant.

K. The method as any of paragraphs D-J recite, wherein the second location comprises a single 3D point proximate to or coincident with the first location, a plurality of 3D points external to the vehicle, or a geometric shape proximate the first location.

L. The method as any of paragraphs D-K recite, wherein the interior of the vehicle is associated with a plurality of regions and, the method further comprises identifying a region of the plurality of regions associated with the event, the region proximate the second location, and wherein the plurality of speakers are associated with the region.

M. One or more non-transitory computer-readable media that, when executed by one or more processors, cause the one or more processors to perform operations comprising: determining a first location of a passenger in a vehicle; determining an occurrence of an event associated with the passenger or the vehicle; determining a three-dimensional (3D) sound associated with the event; sending a signal associated with the 3D sound to a speaker system comprised of a plurality of speakers and configured to direct sound to an interior of the vehicle; and responsive to receiving the signal, causing the 3D sound to be output via the speaker system such that a sound associated with the 3D sound is to be perceived by the passenger as emanating from a second location.

N. The one or more non-transitory computer-readable media as paragraph M recites, the operations further comprising: determining, based at least in part on sensor data from a sensor in the interior of the vehicle, an indication that a seatbelt of the passenger is not fastened; and determining the occurrence of the event responsive to receiving the indication, the event indicative of an unfastened seatbelt, wherein the 3D sound is configured to prompt the passenger to fasten the seatbelt or another passenger to tell the passenger to fasten the seatbelt.

O. The one or more non-transitory computer-readable media as any of paragraphs M-N recite, the operations further comprising: receiving, from a planning system associated with the vehicle, an indication of an action of the vehicle; and determining the occurrence of the event responsive to receiving the indication, wherein the 3D sound is configured to inform the passenger of the action.

P. The one or more non-transitory computer-readable media as paragraph O recites, wherein the action is associated with a passenger pick-up or a passenger drop-off.

Q. The one or more non-transitory computer-readable media as any of paragraphs M-P recites, the operations further comprising: receiving, from a sensor system or interior system of the vehicle, an indication of a voice engagement; and determining the occurrence of the event responsive to receiving the indication.

R. The one or more non-transitory computer-readable media as any of paragraphs M-Q recites, wherein the second location comprises a 3D point internal to the vehicle, a plurality of 3D points internal to the vehicle, a 3D point external to the vehicle, a plurality of 3D points external to the vehicle, or a geometric shape.

S. The one or more non-transitory computer-readable media as any of paragraphs M-R recites, the operations further comprising: determining a third location of another passenger in the vehicle; determining a second occurrence of a second event associated with the other passenger in the vehicle; determining another 3D sound associated with the second event; sending another signal associated with the other 3D sound to the speaker system; and responsive to receiving the other signal, causing the other 3D sound to be output via the speaker system such that another sound associated with the other 3D sound is to be perceived by the other passenger as emanating from a fourth location, wherein the 3D sound and the other 3D sound are output substantially simultaneously.

T. The one or more non-transitory computer-readable media as any of paragraphs M-S recites, wherein the operations further comprise: determining a third location of another passenger in the vehicle; determining that the occurrence of the event is associated with the passenger, the other passenger, or the vehicle; and responsive to receiving the signal, causing the 3D sound to be output via the speaker system such that the sound associated with the 3D sound is to be perceived by the passenger as emanating from the second location and the other passenger as emanating from a fourth location.

U. While paragraphs A-C are described above with respect to a system, it is understood in the context of this document that the content of paragraphs A-C may also be implemented via a method, device, and/or computer storage media. While paragraphs D-L are described above with respect to a method, it is understood in the context of this document that the content of paragraphs D-L may also be implemented via a system, device, and/or computer storage media. While paragraphs M-T are described above with respect to a non-transitory computer-readable medium, it is understood in the context of this document that the content of paragraphs P-T may also be implemented via a method, device, and/or system.

CONCLUSION

Although the discussion above sets forth example implementations of the described techniques, other architectures can be used to implement the described functionality, and are intended to be within the scope of this disclosure. Furthermore, although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A system comprising:

one or more processors; and one or more computer-readable instructions that, when executed by the one or more processors, cause the system to:

receive sensor data from a sensor in an interior of an autonomous vehicle;

determine, based at least in part on the sensor data, a first location of a passenger in the autonomous vehicle;

determine, based on a vehicle system onboard the autonomous vehicle, an occurrence of an event associated with the passenger in the autonomous vehicle;

send, based at least in part on determining the occurrence of the event, a signal associated with a three-dimensional (3D) sound to a speaker system configured to direct sound to an interior of the autonomous vehicle, the 3D sound corresponding to the event; and cause the 3D sound to be output by the speaker system based at least in part on the signal and the first location of the passenger, wherein the 3D sound, when output by the speaker system, is configured to be perceived as though the 3D sound is being emitted from a second location, and wherein the second location is different from, and is determined based on, the first location of the passenger in the autonomous vehicle.

2. The system as claim 1 recites, wherein the interior of the autonomous vehicle is associated with a plurality of regions and the one or more computer-readable instructions further cause the system to:

identify a region of the plurality of regions associated with the event, the region proximate the second location; and cause the 3D sound to be output via two or more speakers of the speaker system that correspond to the region.

3. The system as claim 1 recites, wherein the event corresponds to a passenger drop-off.

4. A method comprising:

determining, based at least in part on sensor data associated with an interior of a vehicle, a first location of a passenger in the vehicle;

determining, by a computing device onboard the vehicle, an occurrence of an event associated with the passenger;

determining a three-dimensional (3D) sound corresponding to the event;

sending a signal associated with the 3D sound to a speaker system configured to direct sound to the interior of the vehicle; and responsive to receiving the signal, outputting the 3D sound via a plurality of speakers of the speaker system such that the 3D sound is configured to be perceived as emanating from a second location relative to the first location of the passenger, wherein the first location and the second location are different locations.

5. The method as claim 4 recites, further comprising:

determining, based at least in part on the sensor data, an indication that a seatbelt of the passenger is not fastened; and determining the occurrence of the event responsive to receiving the indication wherein the second location is near the first location.

6. The method as claim 4 recites, further comprising:

receiving, from a planning system associated with the vehicle, an indication of an action affecting the passenger; and determining the occurrence of the event responsive to receiving the indication wherein the action is associated with a passenger pick-up or a passenger drop-off, and wherein the signal is sent based at least in part on receiving the indication of the action.

7. The method as claim 4 recites, further comprising:

determining, based at least in part on input via a microphone associated with the interior of the vehicle or a cellular receiver associated with the vehicle, a voice engagement; and determining the occurrence of the event responsive to determining the voice engagement.

8. The method as claim 7 recites, further comprising:

prior to determining the voice engagement and determining the occurrence of the event, outputting an auditory output via the speaker system, wherein the auditory output is configured to be perceived as emanating from a third location internal to the vehicle;

responsive to determining the voice engagement, outputting the auditory output via the speaker system, wherein the auditory output is configured to be perceived as emanating from a fourth location external to the vehicle;

outputting a voice output associated with the event via the speaker system, wherein the voice output is configured to be perceived as emanating from the second location;

determining a conclusion of the voice engagement; and responsive to determining the conclusion of the voice engagement, outputting the auditory output via the speaker system, wherein the auditory output is configured to be perceived as emanating from the third location.

9. The method as claim 7 recites, wherein the voice engagement is a phone call or an interaction with a virtual assistant.

10. The method as claim 4 recites, wherein the second location comprises a single 3D point proximate to or coincident with the first location, a plurality of 3D points external to the vehicle, or a geometric shape proximate the first location.

11. The method as claim 4 recites, wherein the interior of the vehicle is associated with a plurality of regions and, the method further comprises identifying a region of the plurality of regions associated with the event, the region proximate the second location, and wherein the plurality of speakers are associated with the region.

12. The method as claim 4 recites, further comprising:

determining a third location of another passenger in the vehicle, the third location being different than the first location;

determining a second occurrence of a second event associated with the other passenger in the vehicle;

determining another 3D sound associated with the second event;

sending another signal associated with the other 3D sound to the speaker system; and responsive to receiving the other signal, causing the other 3D sound to be output via the speaker system such that the other 3D sound is configured to be perceived as emanating from a fourth location relative to the third location, wherein the 3D sound and the other 3D sound are output substantially simultaneously and the third location is different from the fourth location.

13. One or more non-transitory computer-readable media that, when executed by one or more processors, cause the one or more processors to perform operations comprising:

determining a first location of a passenger in a vehicle;

determining an occurrence of an event associated with the passenger;

determining a three-dimensional (3D) sound associated with the event;

sending a signal associated with the 3D sound to a speaker system comprised of a plurality of speakers and configured to direct sound to an interior of the vehicle; and responsive to receiving the signal, causing the 3D sound to be output via the speaker system such that the 3D sound is configured to be perceived as emanating from a second location relative to the first location, wherein the second location is different from the first location.

14. The one or more non-transitory computer-readable media as claim 13 recites, the operations further comprising:

determining, based at least in part on sensor data from a sensor in the interior of the vehicle, an indication that a seatbelt of the passenger is not fastened; and determining the occurrence of the event responsive to receiving the indication, the event indicative of an unfastened seatbelt, wherein the 3D sound is configured to prompt the passenger to fasten the seatbelt or another passenger to tell the passenger to fasten the seatbelt.

15. The one or more non-transitory computer-readable media as claim 13 recites, the operations further comprising:

receiving, from a planning system associated with the vehicle, an indication of an action of the vehicle; and determining the occurrence of the event responsive to receiving the indication, wherein the 3D sound is configured to inform the passenger of the action.

16. The one or more non-transitory computer-readable media as claim 15 recites, wherein the action is associated with a passenger pick-up or a passenger drop-off.

17. The one or more non-transitory computer-readable media as claim 13 recites, the operations further comprising:

receiving, from a sensor system or interior system of the vehicle, an indication of a voice engagement; and determining the occurrence of the event responsive to receiving the indication.

18. The one or more non-transitory computer-readable media as claim 13 recites, wherein the second location comprises a 3D point internal to the vehicle, a plurality of 3D points internal to the vehicle, a 3D point external to the vehicle, a plurality of 3D points external to the vehicle, or a geometric shape.

19. The one or more non-transitory computer-readable media as claim 13 recites, the operations further comprising:

determining a third location of another passenger in the vehicle;

determining a second occurrence of a second event associated with the other passenger in the vehicle;

determining another 3D sound associated with the second event;

sending another signal associated with the other 3D sound to the speaker system; and responsive to receiving the other signal, causing the other 3D sound to be output via the speaker system such that the other 3D sound is configured to be perceived as emanating from a fourth location, wherein the 3D sound and the other 3D sound are output substantially simultaneously.

20. The one or more non-transitory computer-readable media as claim 13 recites, wherein the operations further comprise:

determining a third location of another passenger in the vehicle;

determining that the occurrence of the event is associated with the passenger, the other passenger, or the vehicle; and responsive to receiving the signal, causing the 3D sound to be output via the speaker system such that the 3D sound is configured to be perceived (i) by the passenger as emanating from the second location and (ii) by the other passenger as emanating from a fourth location.

* * * * *